US007465906B2

(12) United States Patent
Wakahara et al.

(10) Patent No.: US 7,465,906 B2
(45) Date of Patent: Dec. 16, 2008

(54) IMAGE HEATING APPARATUS

(75) Inventors: Shinichiro Wakahara, Tokyo (JP); Koki Watanabe, Moriya (JP); Jiro Shirakata, Kashiwa (JP); Koji Takematsu, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/750,825

(22) Filed: May 18, 2007

(65) Prior Publication Data

US 2007/0228034 A1 Oct. 4, 2007

Related U.S. Application Data

(62) Division of application No. 11/254,797, filed on Oct. 21, 2005.

(30) Foreign Application Priority Data

Oct. 22, 2004 (JP) ..... 2004-308506

(51) Int. Cl.
*H05B 6/14* (2006.01)

(52) U.S. Cl. ..... 219/619; 399/328; 399/330

(58) Field of Classification Search ..... 219/619, 219/216; 399/328–330, 333–335, 320
See application file for complete search history.

(56) References Cited

U.S. PATENT DOCUMENTS

| | | | | |
|---|---|---|---|---|
| 7,009,158 | B2 | 3/2006 | Sekiguchi et al. | 219/619 |
| 7,099,616 | B2 | 8/2006 | Kato et al. | |
| 7,107,000 | B2 | 9/2006 | Watanabe et al. | |
| 2004/0206750 | A1 | 10/2004 | Sekiguchi et al. | 219/619 |
| 2004/0253027 | A1 * | 12/2004 | Kato et al. | 399/328 |
| 2006/0086722 | A1 | 4/2006 | Takematsu et al. | |
| 2006/0086725 | A1 | 4/2006 | Hosoi et al. | |
| 2006/0086727 | A1 | 4/2006 | Takematsu et al. | |
| 2006/0086731 | A1 | 4/2006 | Shirakata et al. | |
| 2006/0088333 | A1 | 4/2006 | Watanabe et al. | |
| 2006/0089314 | A1 | 4/2006 | Wakahara et al. | |
| 2006/0138126 | A1 | 6/2006 | Watanabe | |

FOREIGN PATENT DOCUMENTS

| | | |
|---|---|---|
| CN | 1525266 A | 1/2004 |
| JP | 10-74009 | 3/1998 |
| JP | 2000-29342 | 1/2000 |
| JP | 2004-265670 | 9/2004 |
| JP | 2004-273249 | 9/2004 |

* cited by examiner

*Primary Examiner*—Quang T Van
(74) *Attorney, Agent, or Firm*—Fitzpatrick, Cella, Harper & Scinto

(57) ABSTRACT

An image heating apparatus includes a coil for generating magnetic flux, a rotatable heat generation member for generating heat by the magnetic flux generated by the coil to heat a recording material, and a magnetic flux adjusting member for adjusting a distribution of the magnetic flux from the coil toward the heat generating member. The apparatus further includes a motor, a first drive transmission member, and a second drive transmission member for moving the magnetic flux adjusting member.

16 Claims, 17 Drawing Sheets

IMAGE HEATING APPARATUS

CROSS-REFERENCE TO RELATED APPLICATION

This application is a divisional of application Ser. No. 11/254,797, filed Oct. 21, 2005.

FIELD OF INVENTION AND RELATED ART

The present invention relates to an image heating apparatus employing one of the heating methods based on electromagnetic induction. In particular, it relates to an image heating apparatus suitable as a fixing apparatus for thermally fixing to a recording medium, an unfixed toner image which is formed of a thermally meltable substance directly on the recording medium, by an image forming apparatus such as a printer, a copying machine, etc., employing one of the electrophotographic or electrostatic image forming methods, or an unfixed image which is formed of a thermally meltable substance indirectly on a recording medium (formed on a primary image bearing member and transferred onto the recording medium), by the image forming apparatus.

A heating apparatus employing a heating method based on electromagnetic induction employs a heating member formed of a substance in which heat can be generated by electromagnetic induction. In operation, a magnetic flux (magnetic field: alternating magnetic flux) is generated in the heating member to heat the heating member by the heat (Joule heat) generated by eddy current electromagnetically induced in the heating member. When such a heating apparatus is used as a fixing apparatus, the heat generated in the heating member is applied to the recording medium and an unfixed toner image borne thereon to thermally fix the unfixed toner image to the surface of the recording medium.

Japanese Laid-open Patent Application 2004-265670 discloses a fixing apparatus employing a heating method based on electromagnetic induction. This fixing apparatus comprises: a rotatable heat roller, in which heat can be generated by electromagnetic induction; a rotatable elastic pressure roller, which is kept pressed upon the heat roller in parallel to the rotatable heat roller; and a coil assembly as a magnetic flux generating means, which is nonrotatively disposed within the hollow of the rotatable heating roller. In operation, high frequency current is flowed through the coil of the coil assembly to generate a high frequency magnetic field to induce electric current in the heat roller to generate heat in the heat roller. With the heat roller heated, a recording medium bearing an unfixed toner image is introduced into, and conveyed through, the pressure nip between the heat roller and elastic pressure roller. As the recording medium is conveyed through the pressure nip, the unfixed toner image on the recording medium is thermally fixed to the surface of the recording medium by the heat from the metallic sleeve.

This fixing apparatus is also provided with a magnetic flux adjusting member (magnetic flux blocking member), which is disposed in the space between the coil assembly as a magnetic flux generating means, and the heat roller as an electromagnetically heatable member, for the purpose of preventing the occurrence of the phenomenon that the temperature of the heat roller (and its adjacencies) unwantedly increases across the areas outside the path of a recording medium. The magnetic flux adjusting member is rendered arcuate on the heat roller side so that its curvature on the heat roller side matches the curvature of the peripheral surface of the heat roller. It is extended from one lengthwise end of the heat roller to the other, in parallel to the axial line of the heat roller, and is rotatably supported at both of the lengthwise ends so that it can be rotated by a driving means located at one of its lengthwise ends, to a predetermined position in which it blocks the magnetic flux. In other words, this fixing apparatus is structured so that the range in which the magnetic flux is allowed to act on the heat roller, can be adjusted in size, in terms of the direction (width direction) perpendicular to the recording medium conveyance direction.

As for the heat exchange efficiency of a heating apparatus of the electromagnetic induction type, the smaller the gap (clearance) between the magnetic flux generating means and the heating member, that is, the member in which heat is electromagnetically generated, the higher the efficiency. However, if the gap is smaller than a certain value, the following problem sometimes occurs, that as the electromagnetically heatable member is deformed by the pressure applied thereto, and/or the magnetic flux adjusting means deforms due to the heat from the electromagnetically heatable member, its own weight, and the like factors, the magnetic flux adjusting means comes into contact with the magnetic flux generating means. In order to prevent this problem, the relationship between the magnetic flux adjusting member and the electromagnetically heatable member is desired to be such that the gap between them is rendered as small as possible, without rendering it too small to ensure that the electromagnetically heatable heating member and pressure roller do not come into contact with each other, even if the electromagnetically heatable heating member deforms due to the pressure applied thereon by the pressure roller, and/or the magnetic flux generating means deforms due to its own weight, the heat from the heating member, and/or the like factors.

Further, for the purpose of reducing in size a heating apparatus of the electromagnetic induction type such as the above described one, it is desired that the magnetic flux adjusting member is disposed within the hollow of the heat roller, near the internal surface of the heat roller, being enabled to be rotationally moved in the direction parallel to the moving direction of the heat roller, along the internal surface of the heat roller, in order to adjust the magnetic flux. Moreover, as described above, the fixing apparatus is structured so that the magnetic flux adjusting member is rotatably supported at both ends thereof in terms of the direction parallel to the rotational axis of the heat roller (magnetic flux adjusting member), and also, so that the magnetic flux adjusting member is rotated by transmitting thereto the driving force from a driving means. Therefore, it suffers from the problem that as the driving force from the driving means is transmitted to the magnetic flux adjusting means, the magnetic flux adjusting means is twisted by the driving force, failing thereby to be properly driven. As one of the means for solving this problem, it is possible to widen the distance between the magnetic flux generating means and the heating member, in consideration of the amount by which the magnetic flux generating means is twisted by the driving force. However, widening the distance between the magnetic flux generating means and the heating member is problematic in that it reduces the efficiency with which heat is electromagnetically generated in the heating member.

In addition, in the case of the above mentioned structural arrangement in which the magnetic flux generating means disposed in the hollow of the electromagnetically heatable heating member is supported at its lengthwise ends, the magnetic flux generating means sags (deforms in the direction of gravity), across the center portion, relative to the lengthwise end portions, due to its own weight, heat applied thereto, and the like, creating thereby such a situation that the distance between the electromagnetically heatable heating member and the magnetic flux adjusting member, or the distance between the magnetic flux generating means and the magnetic flux adjusting member, becomes abnormally small, or such a situation that the magnetic flux adjusting member comes into contact with the magnetic flux generating means or the heating member. The contact between the magnetic flux adjusting member and the magnetic flux generating means or the heating member creates such a problem as failure of the heating member to be properly rotated, and/or frictional wear of the heating member.

SUMMARY OF THE INVENTION

Thus, the primary object of the present invention is to prevent the magnetic flux adjusting member disposed between the magnetic flux generating means and the electromagnetically heatable member of a heating apparatus employing one of the heating methods based on electromagnetic induction, from being twisted as a driving force is applied thereto, in order to solve the problem that the magnetic flux adjusting member of the heating apparatus malfunctions due to the contact between the magnetic flux adjusting member and the magnetic flux generating means.

Another object of the present invention is to reduce the possibility that the magnetic flux adjusting means and electromagnetically heatable member of an image heating apparatus employing one of the heating methods based on electromagnetic induction come into contact with each other due to the deformation of the magnetic flux adjusting member attributable to its own weight, heat from the electromagnetically heatable member, and the like factors, and the deformation of the electro-magnetically heatable member attributable to the pressure applied thereto, while improving the image heating apparatus in heat generation efficiency.

Another object of the present invention is to prevent the magnetic flux adjusting member of an image heating apparatus employing one of the heating methods based on electromagnetic induction, from malfunctioning, in order to properly control the temperature increase of the electromagnetically heatable member, across the portions outside the path of a recording medium, while improving the image heating apparatus in heat generation efficiency.

According to an aspect of the present invention, there is provided an image heating apparatus comprising magnetic flux generating means; a rotatable heat generation member for generating heat by a magnetic flux generated by said magnetic flux generating means to heat a recording material; a magnetic flux adjusting member, disposed between said magnetic flux generating means and said heat generation member, for adjusting a magnetic flux effective region for said heat generation member, with respect to a longitudinal direction which is perpendicular to a feeding direction of the recording material; moving means for moving said magnetic flux adjusting member to a predetermined magnetic flux adjusting position to adjust a temperature distribution of said heat generation member with respect to the longitudinal direction; and a drive receiving portion, disposed at opposite end portions of said magnetic flux adjusting member, for receiving a driving force from said moving means.

According to the above described structural arrangement, it is possible to prevent the malfunction of the magnetic flux adjusting member attributable to the twisting of the magnetic flux adjusting member. Further, it is possible to prevent the distance between the magnetic flux generating member and electromagnetically heatable member from being widened by the twisting of the magnetic flux adjusting member attributable to the load to which it is subjected as it is driven.

Also according to the above described structural arrangement, the distance between the magnetic flux adjusting member and electromagnetically heatable member, which is changed by the deformation of the magnetic flux adjusting member attributable to the weight of the magnetic flux adjusting member itself, and the deformation of the electromagnetically heatable member attributable to the pressure applied thereto, can be set to an optional value, making it therefore possible to optimize the distance between the magnetic flux adjusting member and electro-magnetically heatable member.

In other words, according to the above described structural arrangement, it is possible to improve the level of accuracy at which the electromagnetically heatable member and magnetic flux generating means are positioned relatively to each other. Therefore, it is possible to dispose the electromagnetically heatable member and magnetic flux generating member substantially closer to each other than it was possible in the past. Therefore, it is possible to improve the heating apparatus in terms of the level of efficiency at which heat is generated in the electromagnetically heatable member by electromagnetic induction. Therefore, it is possible to reduce the length of time necessary to start up the heating apparatus, that is, the length of time necessary to increase the temperature of the electromagnetically heatable member to a predetermined level for heating.

Further, according to the above described structural arrangement, the magnetic flux adjusting member is prevented from malfunctioning. Therefore, the magnetic flux adjusting member can be reliably moved to one of the predetermined positions according to the size of an object to be heated. Therefore, it is possible to properly control the temperature increase of the electromagnetically heatable member, which occurs across the portions outside the recording medium path.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

(1) Example of Image Forming Apparatus

Figure 1:
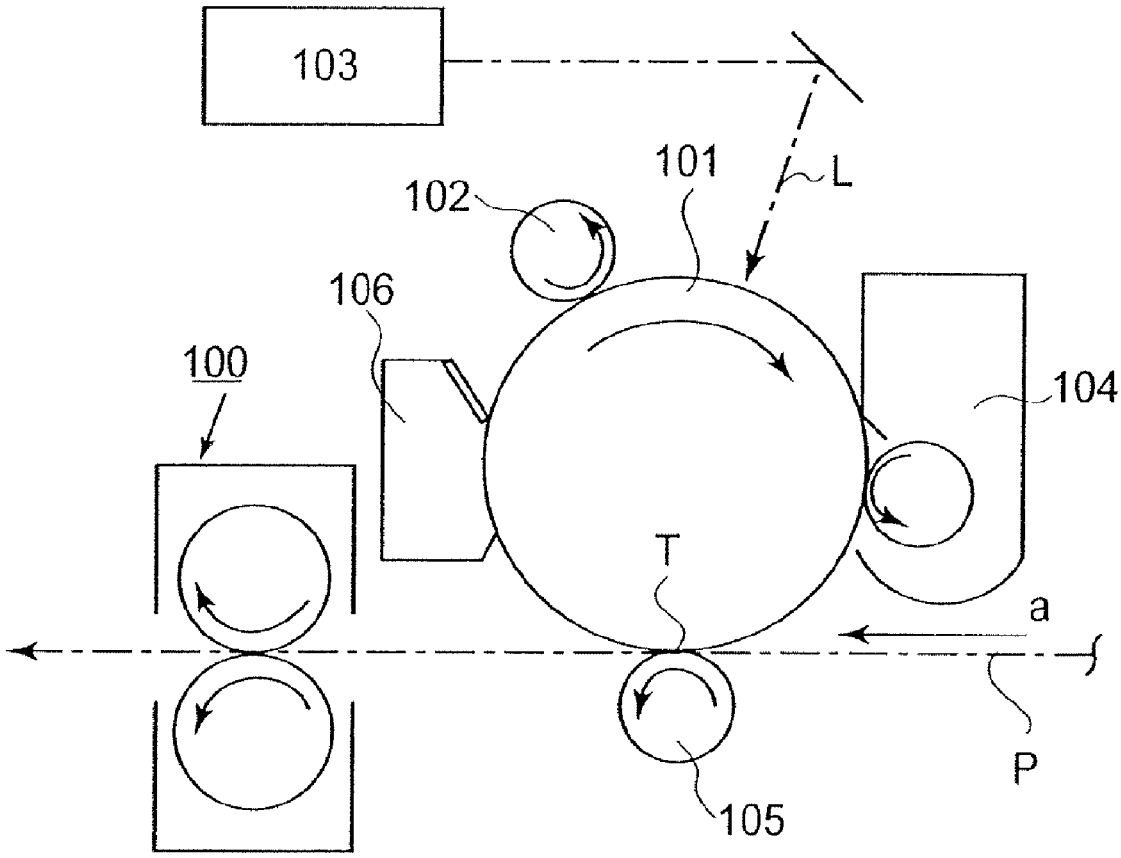
FIG. 1 is a schematic drawing of a typical image forming apparatus.

FIG. 1 is a schematic drawing of a typical image forming apparatus employing a heating apparatus, as a thermal image fixing apparatus (which hereinafter will be referred to simply as a fixing apparatus), in accordance with the present invention, which uses the heating method based on electromagnetic induction, showing the general structure thereof. This example of image forming apparatus 100 is a laser printer, which uses one of the electrophotographic processes of the transfer type.

Designated by a referential symbol 101 is an electrophotographic photosensitive member (which hereinafter will be referred to simply as a photosensitive drum), which is rotationally driven in the clockwise direction indicated by an arrow mark, at a predetermined peripheral velocity.

Designated by a referential symbol 102 is a charge roller, as a charging means, of the contact type, which uniformly charges the peripheral surface of the photosensitive drum 101 to predetermined polarity and potential level as the photosensitive drum 101 is rotated.

Designated by a referential symbol 103 is a laser scanner as an exposing means, which scans the uniformly charged peripheral surface of the photosensitive drum 101 by emitting a beam of laser light L while modulating it with sequential digital electrical signals which reflect the image formation data, as the photosensitive drum 101 is rotationally driven. As a result, an electrostatic latent image is formed on the peripheral surface of the photosensitive drum 101, in the pattern in which the peripheral surface of the photosensitive drum 101 is scanned by the beam of laser light L.

Designated by a referential symbol 104 is a developing apparatus, which normally or reversely develops the electrostatic latent image on the peripheral surface of the photosensitive drum 101, into an image formed of toner (which hereinafter will be referred to simply as a toner image).

Designated by a referential symbol 105 is a transfer roller as a transferring means, which is kept pressed upon the peripheral surface of the photosensitive drum 101 with the application of a predetermined amount of pressure, forming a transfer nip T, to which a recording medium P as an object to be heated is conveyed from an unshown recording medium feeding/conveying mechanism with a predetermined control timing, and then, is conveyed through the transfer nip T while remaining pinched by the photosensitive drum 101 and transfer roller 105. As the recording medium P is conveyed through the transfer nip T, a predetermined transfer bias is applied to the transfer roller 105 with predetermined control timing. As a result, the toner image on the peripheral surface of the photosensitive drum 101 is electrostatically and gradually transferred onto the surface of the recording medium P.

After being conveyed out of the transfer nip T, the recording medium P is separated from the peripheral surface of the photosensitive drum 101, and introduced into the fixing apparatus 100, which fixes the unfixed toner image on the recording medium P by applying heat and pressure to the introduced recording medium and the unfixed toner image thereon; it turns the unfixed image into a permanent image. After the fixation, the recording medium P is conveyed out of the fixing apparatus.

Designated by a referential symbol 106 is a device for cleaning the photosensitive drum 101, which removes the transfer residual toner, that is, the toner remaining on the peripheral surface of the photosensitive drum 101 after the separation of the recording medium P from the peripheral surface of the photosensitive drum 101. After the cleaning of the peripheral surface of the photosensitive drum 101, that is, the removal of the transfer residual toner, the peripheral surface of the photosensitive drum 101 is used for the following image formation cycle; the peripheral surface of the photosensitive drum 101 is repeatedly used for image formation.

The direction indicated by a referential symbol a is the direction in which the recording medium P is conveyed. As for the positioning of the recording medium P relative to the main assembly of the image forming apparatus, in terms of the direction perpendicular to the recording medium conveyance direction a, the recording medium P is conveyed through the main assembly so that the centerline of the recording medium P is kept aligned with the center of the fixing apparatus (fixation roller).

(2) Fixing Apparatus 100

Figure 2:
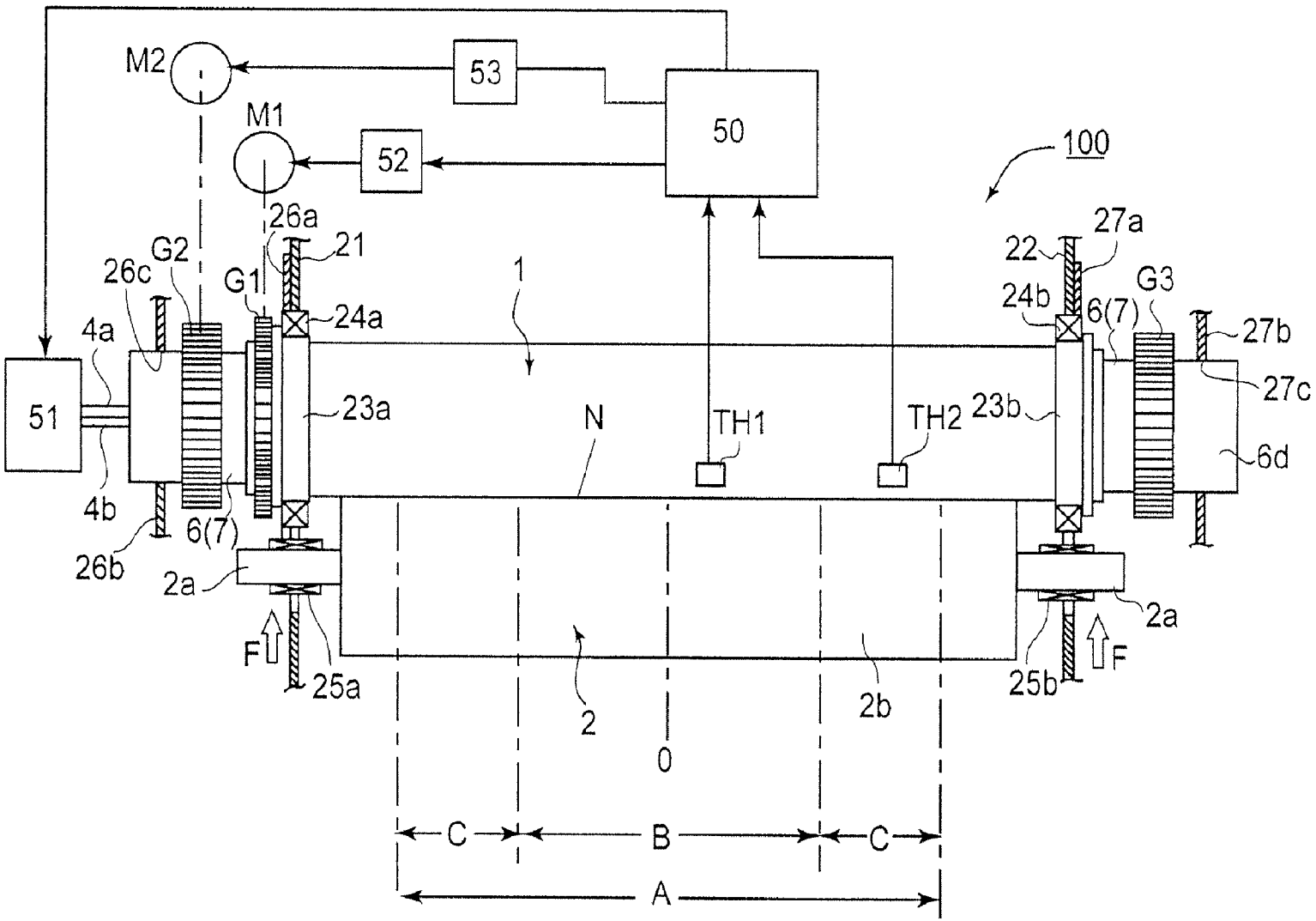
FIG. 2 is a schematic front view of the essential portions of the fixing apparatus.
Figure 3:
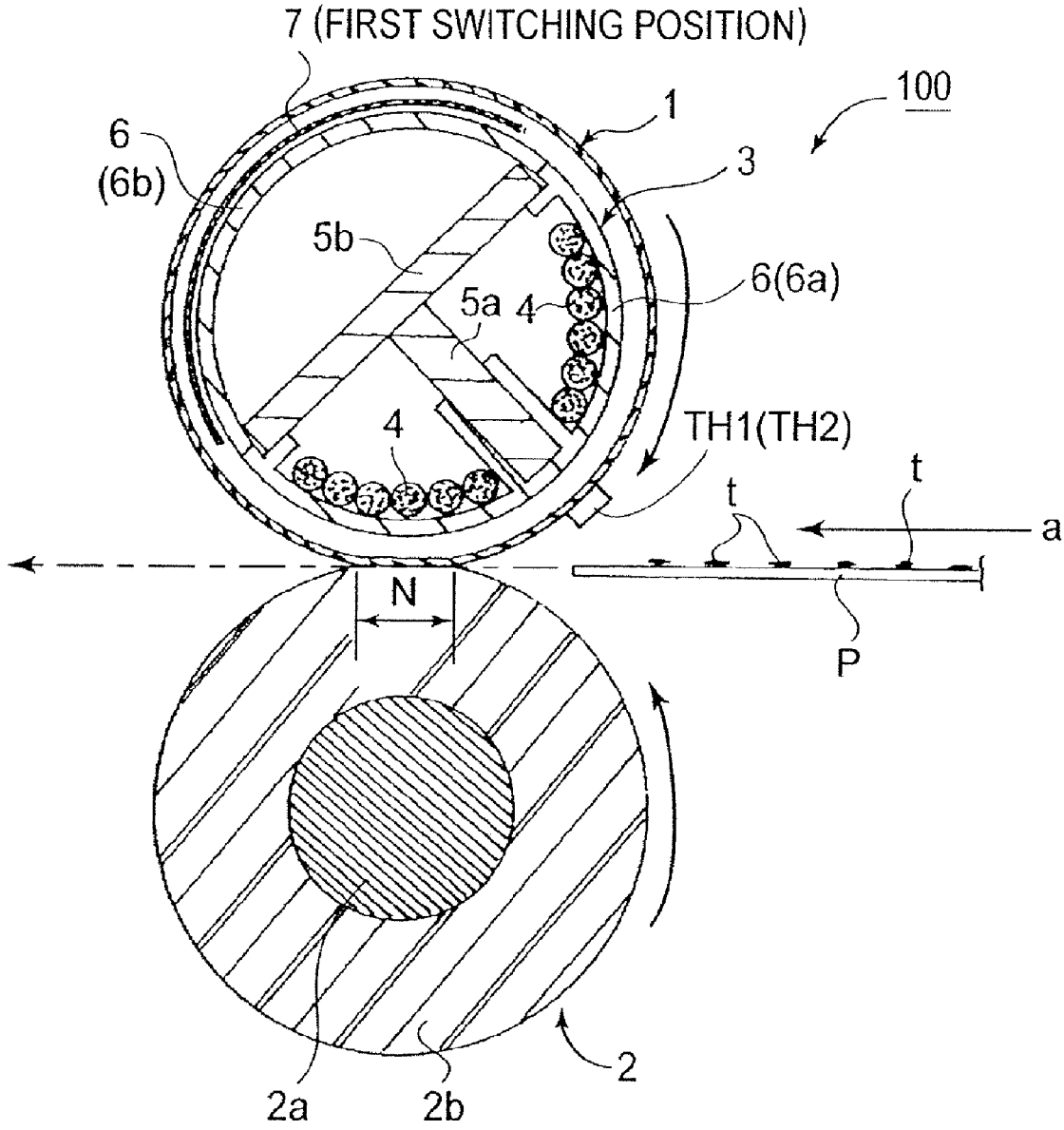
FIG. 3 is an enlarged schematic cross-sectional view of the essential portions of the fixing apparatus.
Figure 4:
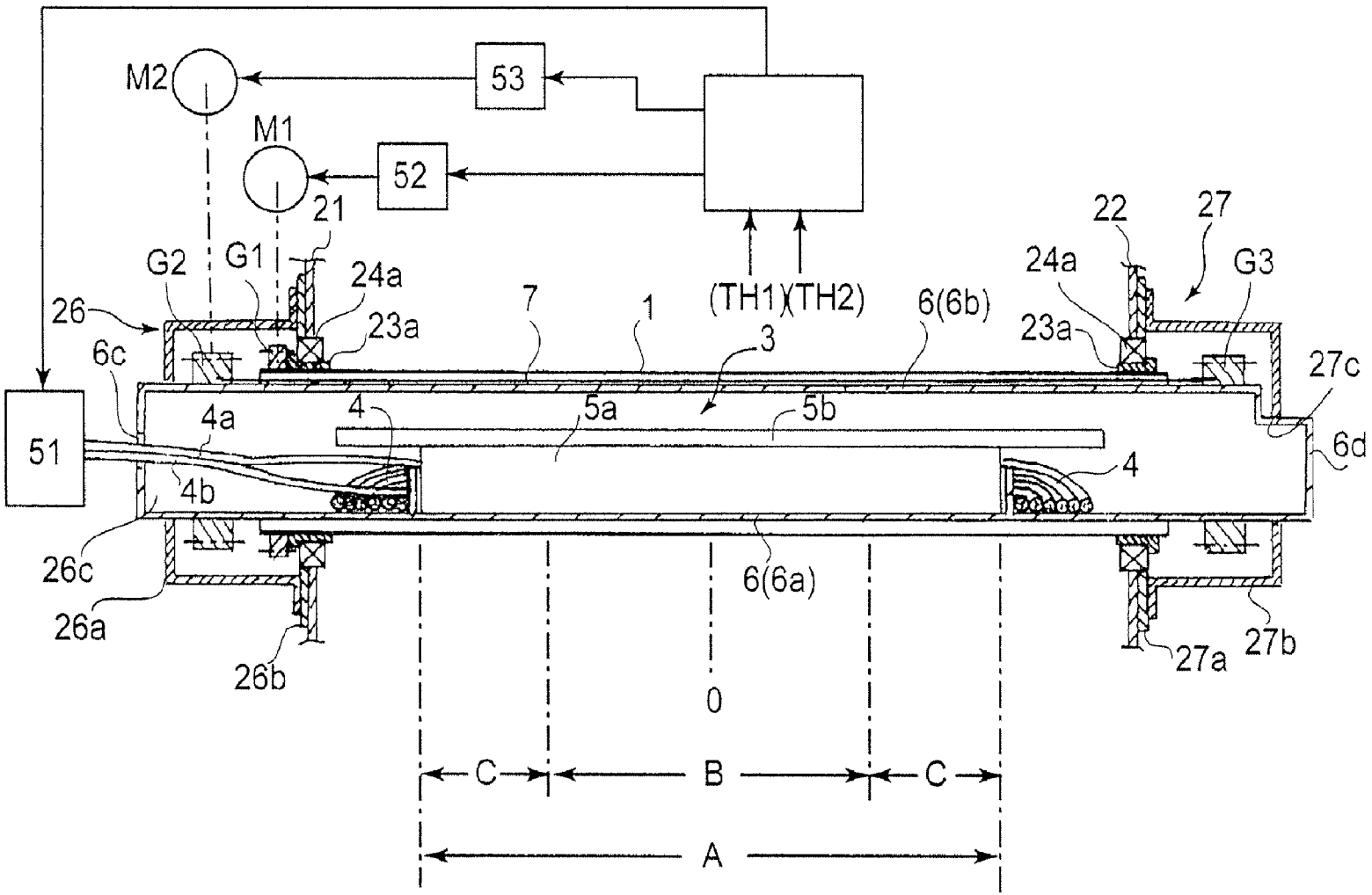
FIG. 4 is a schematic vertical sectional view of the fixation roller assembly of the fixing apparatus.

FIG. 2 is a schematic front view of the essential portions of the fixing apparatus as an image heating apparatus, and FIG. 3 is an enlarged schematic cross-sectional view of the essential portions of the fixing apparatus. FIG. 4 is a schematic vertical sectional view of the fixation roller assembly portion of the fixing apparatus.

For the degree of accuracy at which the fixation roller, as a member in which heat can be generated by electromagnetic induction, is positioned relative to an exciting coil assembly as a magnetic flux generating means (heating means), the fixing apparatus in this embodiment is structured so that the fixation roller and exciting coil assembly are coaxially supported by the positioning members, inclusive of the means for accurately positioning the supporting member for rotatably supporting the fixation roller and the means for accurately positioning the exciting coil assembly.

Designated by a referential symbol 1 is the fixation roller as a member in which heat can be generated by electromagnetic induction. The fixation roller 1 is formed of such a substance as iron, nickel, and SUS 430 (electrically conductive magnetic substance), in which heat can be generated by electromagnetic induction. It is a cylindrical, and the thickness of its wall is in the range of 0.1 mm-1.5 mm. Generally, it comprises a toner releasing layer as the surface layer, or the combination of a toner releasing layer, an elastic layer, etc. Using one of the ferromagnetic metals (metallic substances with high level of permeability), as the material for the fixation roller, makes it possible to confine a larger portion of the magnetic flux generated by the magnetic flux generating means, in the wall of the fixation roller 1. In other words, it makes it possible to increase the fixation roller in magnetic flux density, making it thereby possible to more efficiently induce eddy current in the surface portion of the metallic fixation roller.

This fixing apparatus 100 is provided with a front plate 21, a rear plate 22, a fixation roller supporting front member 26 (fixation roller positioning plate), a fixation roller supporting rear member 27 (fixation roller positioning plate). To the fixation roller supporting members 26 and 27, first supporting portions 26*a* and 27*a* are attached, respectively. The fixation roller 1 is provided with a pair of heat insulating bushings 23*a* and 23*b*, which are fitted around the lengthwise end portions of the fixation roller 1. It is rotatably supported at the front and rear lengthwise end portions by the portions 26*a* and 27*a* of the front and rear supporting members 26 and 27, with the interposition of bearings 24*a* and 24*b* disposed between the bushing 23*a* and the portion 26*a* of the front supporting member 26, and between the bushing 23*b* and portion 27*a* of the rear supporting member 27, respectively.

Figure 7:
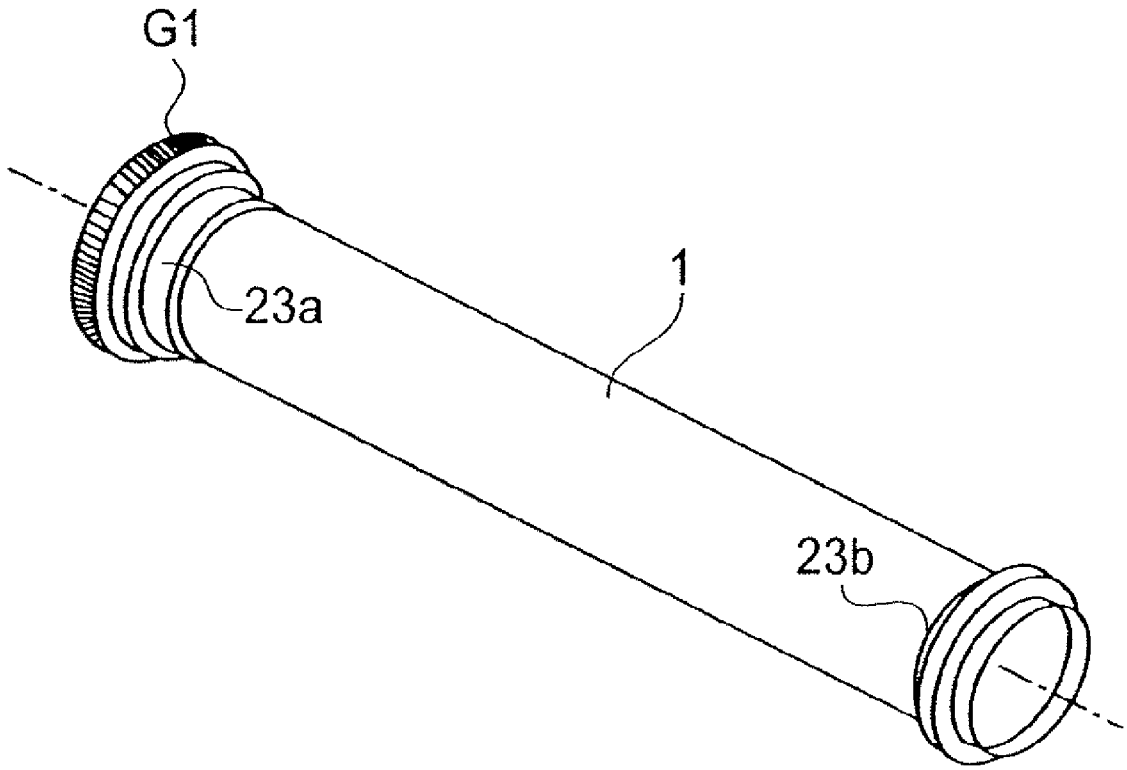
FIG. 7 is an external perspective view of the fixation roller to which the thermally insulating bushings and fixation roller gear have been attached.

The heat insulating bushings 23*a* and 23*b* are employed to minimize the heat transmission from the fixation roller 1 to the bearings 24*a* and 24*b*. Designated by a referential symbol G1 is a fixation roller driving gear fitted fast around the front end portion of the fixation roller 1. As the rotational force from a first motor M1 is transmitted to this gear G1 through a driving force transmission system (unshown), the fixation roller 1 is rotationally driven at a predetermined peripheral velocity in the clockwise direction indicated by an arrow mark in FIG. 3. FIG. 7 is an external perspective view of the fixation roller 1 fitted with the pair of heat insulating bushings 23*a* and 23*b* and the fixation roller gear G1.

Designated by a referential symbol 2 is a pressure roller as a pressure applying member, which is an elastic roller made up of a metallic core 2*a*, a cylindrical elastic layer 2*b* fitted integrally and concentrically around the metallic core 2*a*, etc. The elastic layer 2*b* is a layer formed of a rubbery substance, for example, silicone rubber, which displays the releasing property and is heat resistant. This elastic roller 2 is disposed under the fixation roller, in parallel to the fixation roller, being rotatably supported by the front and rear end portions of the metallic core 2*a*, with a pair of bearings 25*a* and 25*b* attached to the front and rear plates 21 and 22, respectively, in such a manner that they can be slid toward the fixation roller 1. Further, the bearings 25*a* and 25*b* are kept pressured upward toward the fixation roller 1 by a pair of pressure applying means (unshown). With the provision of the above described structural arrangement, the pressure roller 2 is pressed against the downwardly facing portion of the peripheral surface of the fixation roller 1, so that a predetermined amount of contact pressure is maintained between the fixation roller 1 and pressure roller 2 against the elasticity of the elastic layer 2*b*. As a result, a fixation nip N, as a heating nip, with a predetermined width is formed between the fixation roller 1 and pressure roller 2. As the fixation roller 1 is rotationally driven, the pressure roller 2 is rotated by the friction which occurs between the fixation roller 1 and pressure roller 2 in the fixation nip N.

Figure 8:
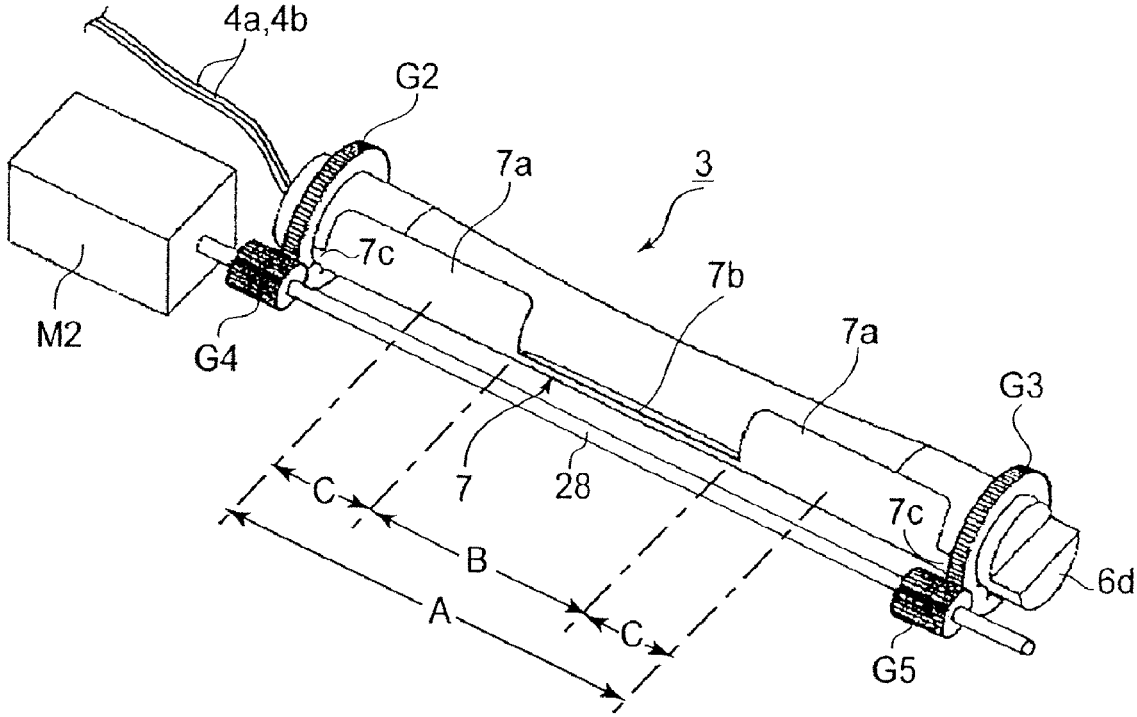
FIG. 8 is an external perspective view of the exciting (excitation) coil assembly and the means for moving the magnetic flux adjusting member.
Figure 9:
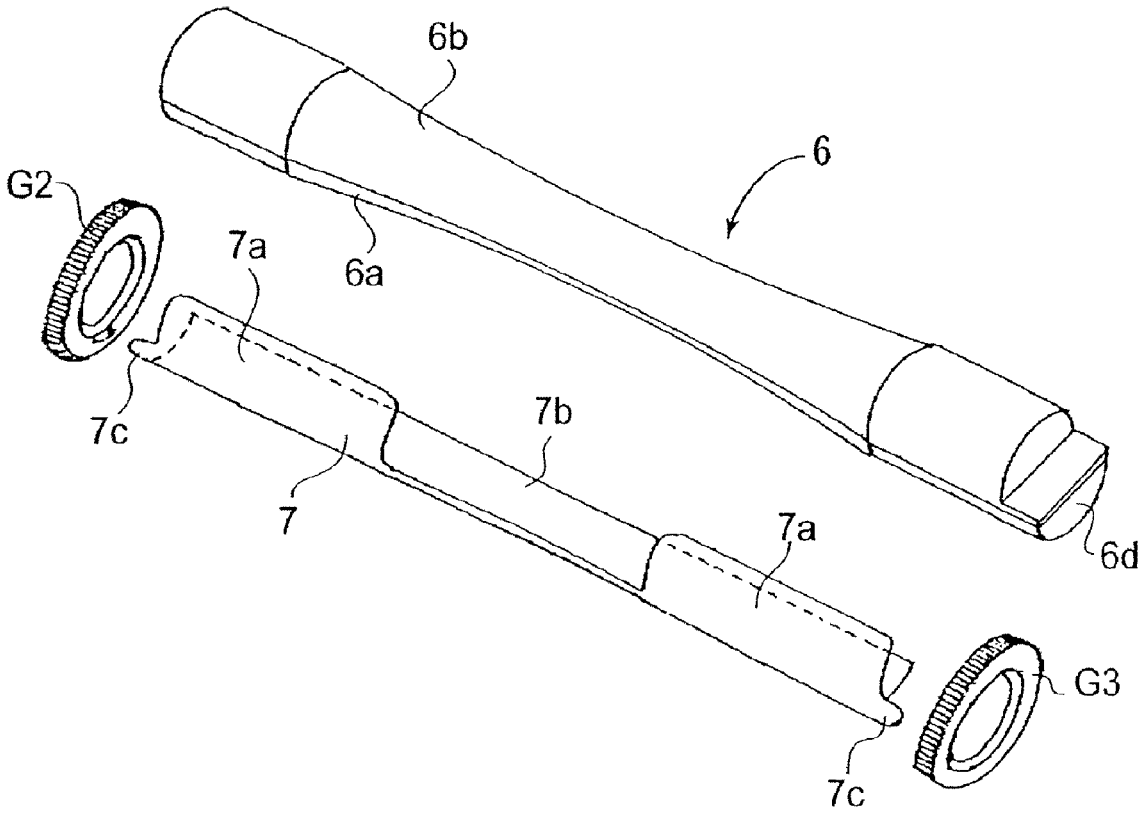
FIG. 9 is an exploded perspective view of the holder and magnetic flux adjusting member.
Figure 10:
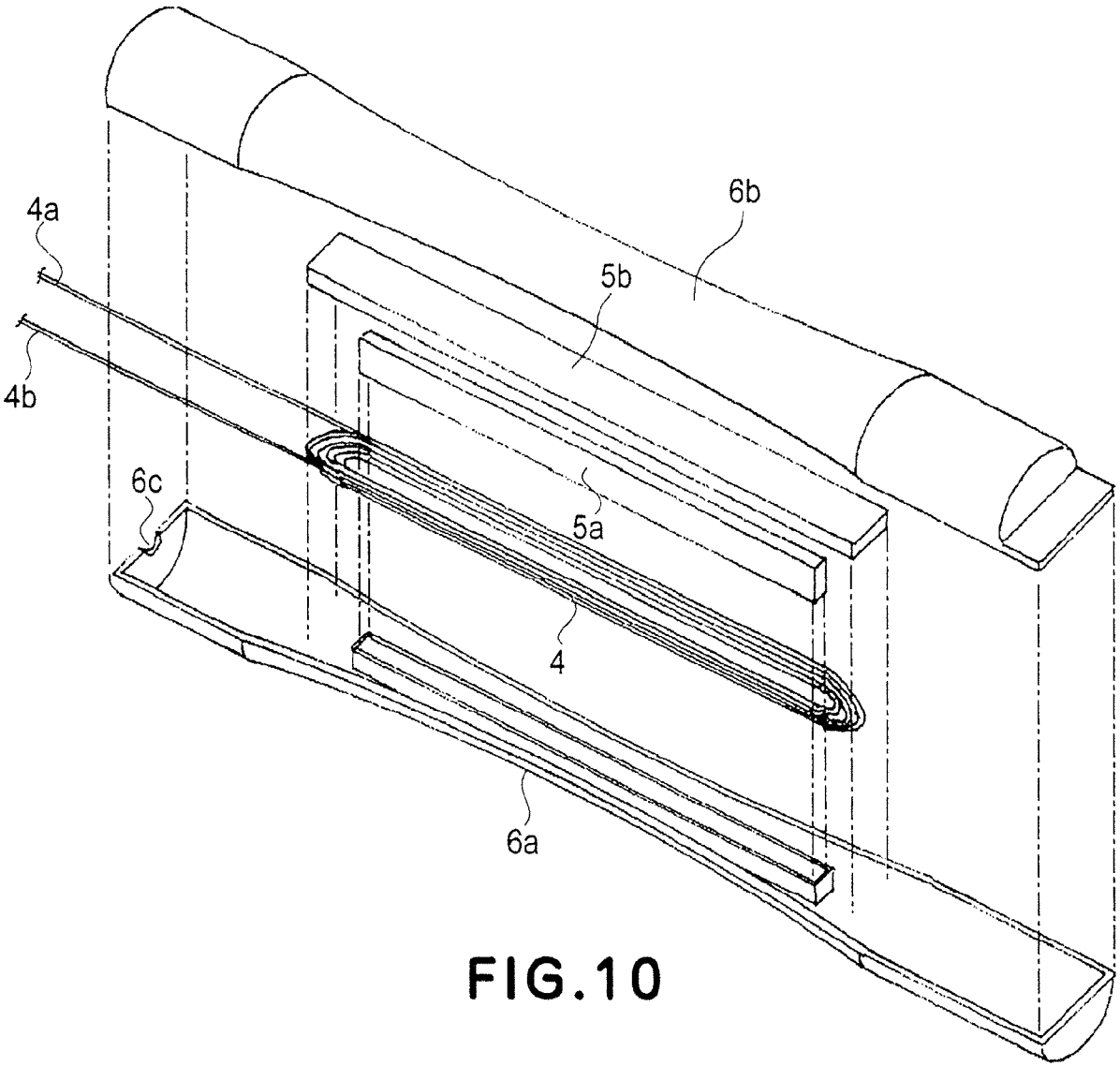
FIG. 10 is an exploded perspective view of the holder and the components therein.

Designated by a referential symbol 3 is an exciting coil assembly as a magnetic flux generating means. This exciting coil assembly 3 is disposed in the hollow of the above mentioned cylindrical fixation roller 1. The exciting coil assembly 3 is made up of an exciting coil 4 (which hereinafter will be referred to simply as a coil), magnetic cores 5*a* and 5*b* (which hereinafter will be referred to simply as cores), and a holder 6. The magnetic cores 5*a* and 5*b* are integrally attached to each other, yielding a component with a T-shaped cross section, and are disposed in the hollow of the holder 6. The exciting coil assembly 3 is also provided with a magnetic flux adjusting member 7 (magnetic flux blocking member (magnetic flux reducing member: shutter)), which is rotatably disposed on the outward side of the holder 6, coaxially with the holder 6. FIG. 8 is an external view of this exciting coil assembly 3 and means M2, 28, G4, and G5 for moving the magnetic flux adjusting member 7. FIG. 9 is an exploded perspective view of the holder 6 and the magnetic flux adjusting member 7. FIG. 10 is an exploded perspective view of the holder 6, and the components therein.

Hereinafter, the lengthwise direction of the structural components or the portions thereof of the fixing apparatus means the direction perpendicular (intersectional) to the recording medium conveyance direction a.

The holder 6 is roughly cylindrical in cross section, from one lengthwise end to the other. As the material therefor, a mixture of PPS resin, which is heat resistant and has mechanical strength, and glass fiber, is used. As for the substances, other than the PPS resin, suitable as the material for the holder 6, PEEK resin, polyimide resin, polyamide resin, polyamide-imide resin, ceramic, liquid polymer, fluorinated resin, and the like are available.

Referring to FIG. 10, the holder 6 is made up of two (first and second) roughly semicylindrical portions 6*a* and 6*b*, which are attached to each other with adhesive, or are interlocked to each other by providing the two portions 6*a* and 6*b* with such a shape that makes it possible to interlock the two portions 6*a* and 6*b* with each other, to form the holder 6, which is roughly cylindrical, from one lengthwise end to the other. The coil 4 and cores 5*a* and 5*b* are disposed in the first semicylindrical portion 6*a*, and then, the second semicylindrical portion 6*b* is bonded to the first semicylindrical portion 6*a* in a manner of encasing the coil 4 and core 5*a* and 5*b*, completing the holder 6 which internally holds the coil 4 and core 5*a* and 5*b*. Designated by referential symbols 4*a* and 4*b* are lead wires, which are extended outward from the holder 6 through a hole 6*c* of the front end wall of the holder 6.

Also referring to FIG. 10, the coil 4 has a roughly elliptical shape (shape of long and narrow boat), the major axis of which is parallel to the lengthwise direction of the fixation roller 1. It is disposed in the hollow of the first semicylindrical portion 6*a* of the holder 6 so that its external contour follows the internal surface of the fixation roller 1. The coil 4 must be capable of generating an alternating magnetic flux strong enough to generate a sufficient amount of heat for fixation. Therefore, the coil 4 must be small in electrical resistance, and high in inductance. As the wire for the coil 4, Litz wire is used, which is made by bundling roughly 80-160 strands of fine wires, the diameter of which is in the range of 0.1-0.3 mm. The Litz wire is wound 6-12 times around the first core 5*a*.

The core 5*a* constitutes a first core (equivalent to vertical portion of letter T) around which the Litz wire is wound. The core 5*b* constitutes a second core (equivalent to horizontal portion of letter T). The two cores 5*a* and 5*b* are attached to each other so that the resultant component will be T-shaped in cross section. As the material for the cores 5*a* and 5*b*, such a substance as ferrite that is high in permeability, and yet, is low in residual magnetic flux density, is preferable. However, the only requirement for the material for the cores 5*a* and 5*b* is that the material is capable of generating magnetic flux. In other words, what is required of the material for the cores 5*a* and 5*b* is not particularly restrictive. Further, the cores 5*a* and 5*b* are not required to be in a specific form, or be made of a specific material. Moreover, the first and second core 5*a* and 5*b* may be formed as parts of a single piece magnetic core, which is T-shaped in cross section.

Referring to FIG. 9, the magnetic flux adjusting member 7 is shaped so that its cross section is arcuate, from one lengthwise end to the other. It has a pair of shutter portions 7*a* and 7*a* having the arcuate cross section, and a connective portion 7*b* having also the arcuate cross section. In terms of the lengthwise direction of the magnetic flux adjusting member 7, the shutter portions 7*a* and 7*a* are the portions adjacent to the lengthwise ends of the magnetic flux adjusting member 7, and the connective portion 7*b* is the center portion of the magnetic flux adjusting member 7, which connects the shutter portions 7*a* and 7*a*. As for the material for the magnetic flux adjusting member 7, such a nonferrous metallic substance as aluminum, copper, or the like is used as the material for the magnetic flux adjusting member 7, and among nonferrous metallic substances, those which are lower in electrical resistance are preferable. The magnetic flux adjusting member 7 is also provided with a pair of protrusions 7*c* and 7*c*, which protrude from the outward edges of the shutter portions 7*a* and 7*a*, one for one, in the lengthwise direction of the magnetic flux adjusting member 7. These protrusions 7*c* and 7*c* are engaged with the first and second shutter gears G2 and G3*c* rotatably fitted around the front and rear end portions of the holder 6. With the provision of the above described structural arrangement, the magnetic flux adjusting member 7 is held at its lengthwise ends by the first and second shutter gears G2 and G3, between the first and second shutter gears G2 and G3.

The fixing apparatus 100 is structured so that the holder 6 of the exciting coil assembly 3 is supported as shown in FIGS. 2 and 4. That is, one of the lengthwise end portions of the cylindrical holder 6 is extended outward beyond the front end of the fixation roller 1, through the front opening of the fixation roller 1, and is fitted in the hole 26*c* of the second portion 26*b* of the front supporting member 26 attached to the outward side of the front plate 21 of the fixing apparatus 100, being thereby supported by the front plate 21. The other lengthwise end portion of the holder 6 is extended outward beyond the rear end of the fixation roller 1, through the rear opening the fixation roller 1, and is fitted in the hole 27*c* of the second portion 27*b* of the rear supporting member 27 attached to the outward side of the rear plate 22 of the fixing apparatus 100, being thereby supported by the rear plate 22. More specifically, the rear end portion of the holder 6 is provided with a D-cut portion 6*d*, and the hole 27*c* of the rear supporting member 27 is D-shaped in cross section. Therefore, the holder 6 is nonrotationally supported by the front and rear plates 26 and 27 of the fixing apparatus 100. Also with the provision of the above described structural arrangement, the holder 6 is disposed in the hollow of the fixation roller 1 so that the two are coaxially disposed while providing a predetermined amount of gap between the peripheral surface of the holder 6 and internal surface of the fixation roller 1, and also, so that the holder 6 is nonrotationally held in a predetermined attitude, that is, at a predetermined angle in terms of its circumferential direction. The aforementioned lead wires 4*a* and 4*b* extending outward from the holder 6 through the hole 6*c*, with which the front end wall of the holder 6 is provided, are connected to an excitation circuit 51. Incidentally, regarding the means for nonrotationally holding the holder 6 at the aforementioned angle (position) in terms of its circumferential direction, in this embodiment, the D-cut end portion 6*d* of the holder 6 is fitted in the hole 27*c* of the portion 27*b* of the second supporting member 27, which is D-shaped in cross section. However, the means for nonrotationally holding the holder 6 at the predetermined angle (position) does not need to be limited to the above described one. That is, any means will suffice as long as the holder 6 can be nonrotationally held at the predetermined angle (position) in terms of its circumferential direction.

As described above, the magnetic flux adjusting member 7 is supported between the first and second shutter gears G2 and G3, by being supported at both of its lengthwise ends by the gears G2 and G3. That is, the protrusions 7*c* and 7*c* (FIGS. 8 and 9), which are the actual lengthwise end portions of the magnetic flux adjusting member 7, are supported by the first and second shutter gears G2 and G3 by being engaged with the first and second shutter gears G2 and G3, respectively, which are rotatably fitted around the front and rear end portions of the holder 6. Thus, as the first and second shutter gears G2 and G3 are rotated by the means M2, 28, G4, and G5 for moving the magnetic flux adjusting member 7, the magnetic flux adjusting member 7 is rotated about the axial line of the holder 6, through the gap between the peripheral surface of the holder 6 and the internal surface of the fixation roller 1.

Referring to FIG. 8 which depicts the means M2, 28, G4, and G5 for moving the magnetic flux adjusting member 7, a referential symbol M2 stands for a second motor; 28: a shaft; G4: first output gear; and a referential symbol G5 stands for a second output gear. The shaft 28, which is located outside the fixation roller 1, is rotatably supported in parallel to the fixation roller 1, by the front and rear plate 22 of the fixing apparatus 100, with a pair of bearings (unshown) placed between the shaft 28 and the plates 22 and 23. The second motor M2 is a driving force source for rotating the shaft 28, and is a stepping motor. The first and second output gears G4 and G5 are rigidly and coaxially attached to the shaft 28. The first and second output gears G4 and G5 are meshed with the first and second shutter gears G2 and G3 of the exciting coil assembly 3, respectively. Thus, as the second motor M2 is rotationally driven, the rotational force is transmitted to the first and second shutter gears G2 and G3, causing thereby the magnetic flux adjusting member 7 to rotate about the axial line of the holder 6 in a manner to follow the peripheral surface of the holder 6. As for the material for the gears, one of the various resinous substances may be selected according to the ambient temperature, and the amount of torque to which they are subjected.

Referring to FIG. 2, designated by a referential symbol 50 is a control circuit portion (CPU), which activates the first motor M1 with a predetermined control timing, through a driver 52, according to an image formation sequence. As the first motor M1 is activated, the rotational force is given to the driving gear G1 of the fixation roller 1, rotationally driving the fixation roller 1 in the clockwise direction indicated by an arrow mark in FIG. 3. The pressure roller 2 is rotated by the rotation of the fixation roller 1.

The control circuit portion 50 also activates the exciting circuit 51 with a predetermined timing, supplying thereby the coil 4 with alternating electric current. As a result, an alternating magnetic flux (alternating magnetic field) is generated, and therefore, heat is generated in the wall of the fixation roller 1 by electromagnetic induction, causing the fixation roller 1 to increase in temperature.

Figure 6:
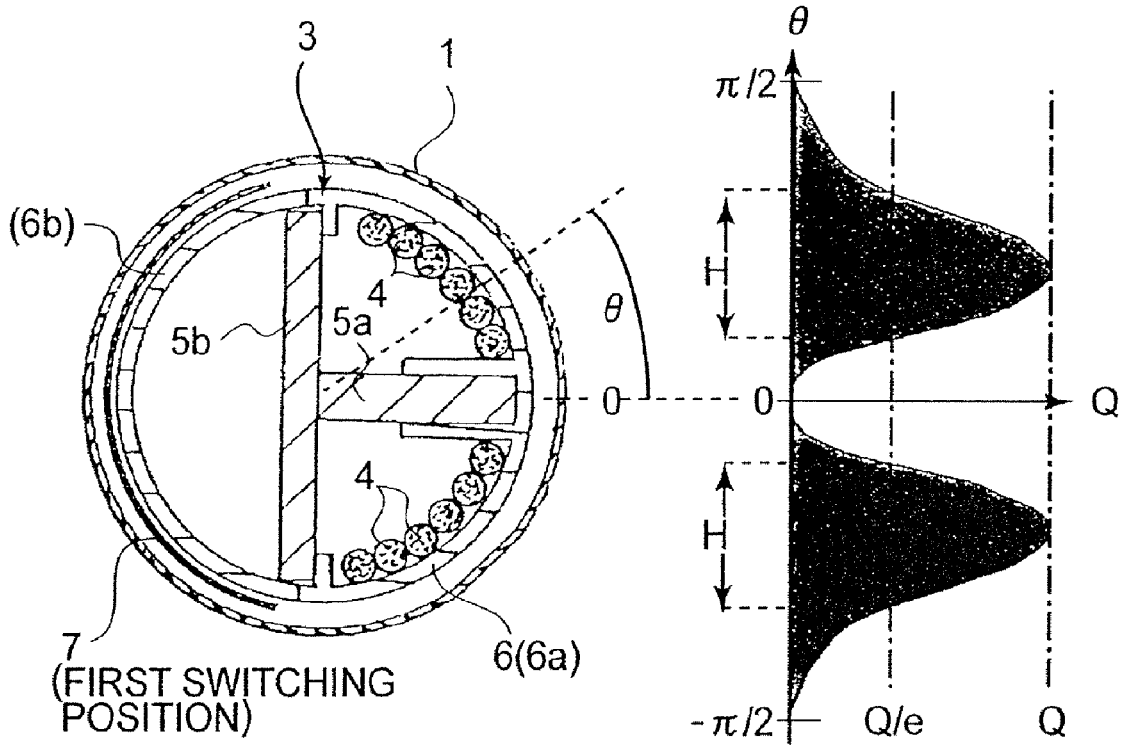
FIG. 6 is a drawing showing the primary area across which a magnetic flux is generated, and the heat distribution, corresponding to the primary area, in terms of the direction parallel to the circumferential direction of the fixation roller.

FIG. 6 is the combination of a schematic cross-sectional view of the fixation roller 1 in the system such as the above described one, and a graph showing the heat distribution of the fixation roller 1 in the heated condition. It shows the areas to which the major portion of the magnetic flux generated by the magnetic flux generating means concentrates, and the corresponding heat distribution of the fixation roller 1, in terms of the circumferential direction of the fixation roller 1. As alternating electric current is flowed through the coil 4, the coil 4 generates an alternating magnetic flux. The fixation roller 1 is formed of a magnetic metal or nonmetallic magnetic substance. Within the wall of the fixation roller 1, eddy current is induced in a manner to neutralize the magnetic field. This eddy current generates heat (Joule heat) in the wall of the fixation roller 1, increasing thereby the fixation roller 1 in temperature.

In the case of the structure of the fixing apparatus in this embodiment, the area in which the magnetic flux is generated is on the outward side of the first semicylindrical portion 6*a* of the holder 6, in which the coil 4 and cores 5*a* and 5*b* are disposed. Thus, the portion of the fixation roller 1, which is in this area, is where heat is generated by the magnetic flux. The heat distribution of the fixation roller 1, in terms of the circumferential direction of the fixation roller 1, across the portion in the abovementioned magnetic flux generation area, has two areas H and H, in which most of the heat is generated, as shown in FIG. 6. In this embodiment, the holder 6 is nonrotationally held (positioned) at such an angle in terms of the circumferential direction of the holder 6 that the portion of the coil 4, which corresponds to one of the two areas H and H, faces the fixation nip N, and the portion of the coil 4, which corresponds to the other of the two areas H and H, faces the immediate adjacencies of the fixation nip N on the upstream side in terms of the rotational direction of the fixation roller 1.

When the magnetic flux adjusting member 7, which is in the gap between the peripheral surface of the holder 6 and the internal surface of the fixation roller 1, is not required to adjust the magnetic flux, it is moved into, and kept in, the position shown in FIGS. 3 and 6, which is on the opposite side of the fixing apparatus from the aforementioned areas in which the magnetic flux is generated. This area in which the magnetic flux adjusting member 7 is kept when the magnetic flux adjusting member 7 is not required to adjust the magnetic flux is where the magnetic flux from the magnetic flux generating means is virtually nonexistent, or extremely low in density. This position shown in FIGS. 3 and 6, in which the magnetic flux adjusting member 7 is kept when the magnetic flux adjusting member 7 is not required to adjust the magnetic flux, will be referred to as first position.

The temperature of the fixation roller 1 is detected by a central thermistor TH1 as a temperature detecting means, disposed at the roughly mid point of the fixation roller 1 in terms of the lengthwise direction thereof, in contact, or with no contact, with the fixation roller 1, and the detected temperature is inputted into the control circuit 50, which controls the temperature of the fixation roller 1 by controlling the electric power supplied from the exciting circuit 51 to the coil 4, so that the fixation roller temperature detected by the central thermistor TH1 and inputted into the control circuit 50 remains at a predetermined target temperature (fixation temperature). While the magnetic flux adjusting member 7 is kept in the first position shown in FIGS. 3 and 6, the fixation roller 1 is controlled in temperature so that the temperature of the fixation roller 1 is kept at the target level across the entirety of its effective range (heatable range) in terms of its lengthwise direction.

While the fixation roller temperature is kept at the predetermined fixation level after being raised thereto, a recording medium P bearing an unfixed toner image t is introduced into the fixation nip N, and is conveyed through the fixation nip N while being kept pinched by the fixation roller 1 and pressure roller 2. As the recording medium P is conveyed through the fixation nip N, the unfixed toner image t on the recording medium P is fixed to the surface of the recording medium P by the heat from the fixation roller 1 and the pressure in the fixation nip N.

Hereinafter, the term, recording medium width, means the dimension of a recording medium, in terms of the direction perpendicular to the recording medium conveyance direction a, when the recording medium P is completely flat. As described above, in this embodiment, the recording medium P is conveyed through the fixing apparatus (image forming apparatus) so that the center of the recording medium P in terms of its width direction coincides with the center of the fixing apparatus (fixation roller 1) in terms of the width direction of the recording medium P. Referring to FIGS. 2 and 4, designated by a referential symbol O is the centerline (hypothetical line), as the referential line, of the fixation roller 1 (recording medium) in terms of its lengthwise direction, and designated by a referential symbol A is the width of the path of the largest recording medium, in terms of width, usable with the image forming apparatus. Designated by a referential symbol B is the width of the path of a recording medium which is one size smaller than the largest recording medium. Hereinafter, a recording medium smaller in width than the largest recording medium will be referred to simply as small recording medium. Designated by a referential symbol C are the areas between the edges of a large recording medium and the edge of a small recording medium. In other words, each of the areas C is the portion of the recording medium passage, which does not come into contact with a small recording medium when the small recording medium is conveyed through the fixing apparatus. Since a recording medium is conveyed through the fixing apparatus so that the center of the recording medium in terms of its width direction coincides with the center of the fixation roller 1 in terms of its lengthwise direction, there will be two areas C, one on the left side of the path B of a small recording medium, and the other on the right side of the path B of a small recording medium. The width of the areas C is changed by the width of the recording medium being conveyed through the fixing apparatus (image forming apparatus).

The above mentioned central thermistor TH1 used for controlling the temperature of the fixation roller 1 is disposed within the path B of a small recording medium so that it will be within the path of a recording medium regardless of recording medium width.

Designated by a referential symbol TH2 is a peripheral thermistor as a temperature detecting means disposed within one of the area C, that is, the areas out-of-path of a recording medium, in terms of the lengthwise direction of the fixation roller 1, in contact, or with no contact, with the fixation roller 1, in order to detect the increase in the temperature of the fixation roller 1, across the portions corresponding to the out-of-path areas C. The temperature data obtained by this peripheral thermistor TH2 are also inputted into the control circuit portion 50.

As multiple small recording mediums are consecutively conveyed through the fixing apparatus 100, the portions of the fixation roller 1 corresponding in position to the out-of-path areas C increases in temperature, and this increase in temperature is detected by the peripheral thermistor TH2, and the detected increase in temperature is inputted from the thermistor TH2 to the control circuit portion 50. As the temperature level of the out-of-path area C inputted into the control circuit portion 50 by the peripheral thermistor TH2 exceeds the predetermined permissible range, the control circuit portion 50 rotates the magnetic flux adjusting member 7 from the first position shown in FIGS. 3 and 6 into the second position shown in FIG. 5 by activating the second motor M2 through the driver 53.

The second position for the magnetic flux adjusting member 7 is such a position that when the magnetic flux adjusting member 7 is in this position, the arcuate shutter portions 7*a* and 7*a*, that is, the virtual end portions of the magnetic flux adjusting member 7 in its lengthwise direction, which are wider, in terms of the circumferential direction of the fixation roller 1, than the connective portion 7*b*, that is, the center portion of the magnetic flux adjusting member 7, are in the following positions. That is, the arcuate shutter portions 7*a* and 7*a* of the magnetic flux adjusting member 7 which is in the gap between the peripheral surface of the holder 6 and the internal surface of the fixation roller 1, are placed in the portions of the above described gap, one for one, which correspond in position to the out-of-path areas C in terms of the lengthwise direction of the fixation roller 1, and also, to the area in which the magnetic flux is generated, in terms of the circumferential direction of the fixation roller 1.

With the magnetic flux adjusting member 7 placed in the second position, the magnetic flux from the magnetic flux generating means is reduced in the amount by which it acts on the portion of the fixation roller 1 which corresponds in position to the out-of-path areas C and C. Therefore, the portions of the fixation roller 1 corresponding to the out-of-path areas C are minimized in the amount by which heat is generated therein. Therefore, the problem that the portions of the fixation roller 1 corresponding to the out-of-path areas C increase in temperature is prevented.

Figure 5:
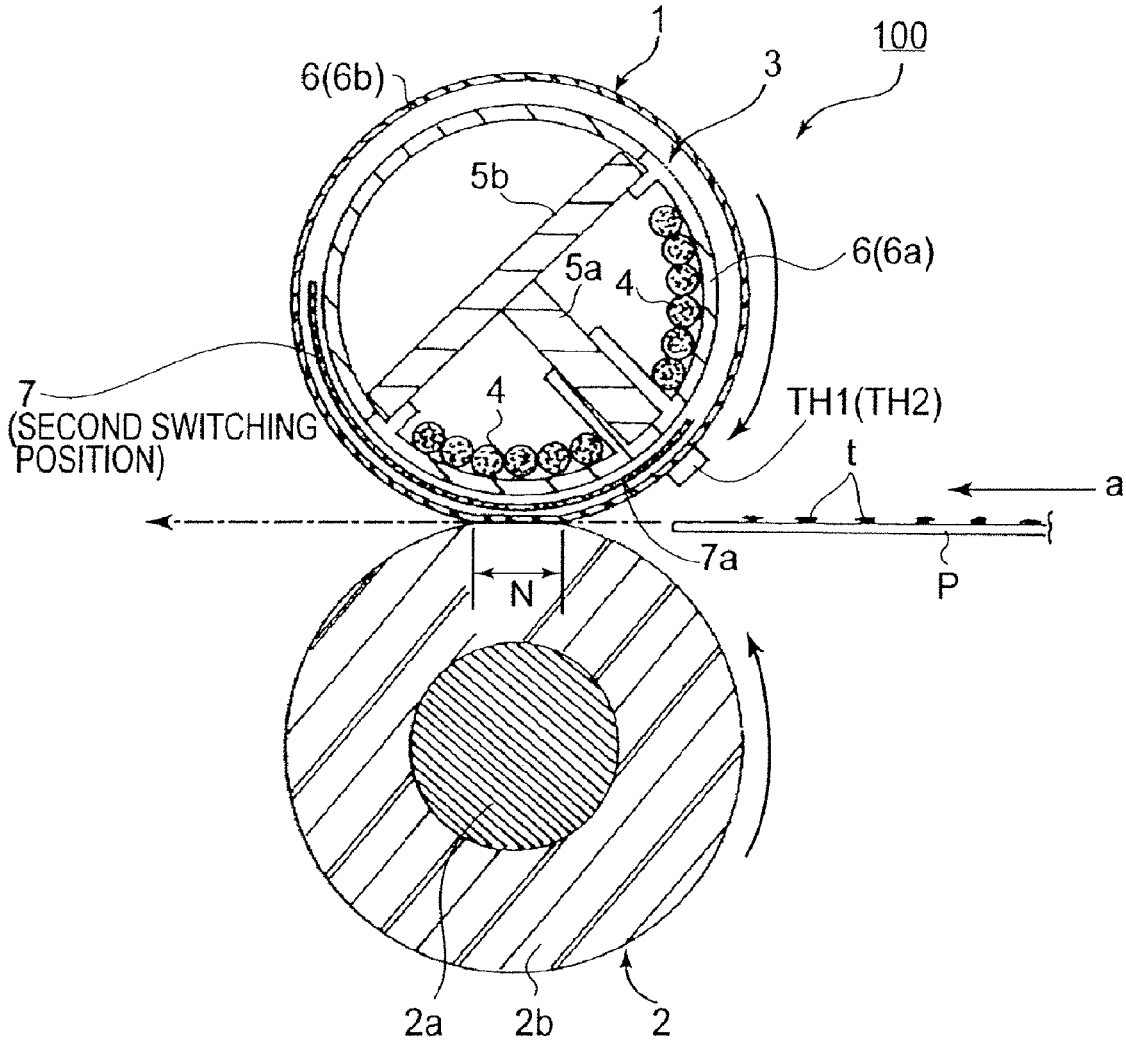
FIG. 5 is an enlarged schematic cross-sectional view of the essential portions of the fixing apparatus in the condition in which the magnetic flux adjusting member is being rotated into the second position.

It is possible to structure the fixing apparatus 100 so that as the magnetic flux adjusting member 7, which is in the gap between the peripheral surface of the holder 6 and the internal surface of the fixation roller 1, is moved into the aforementioned second position, the shutter portions 7*a* and 7*a*, which correspond in position to the out-of-path areas C and C, extend from one end of the magnetic flux generation area, in terms of the circumferential direction of the fixation roller 1 (holder 6), to the other, or a part of the way to the other. FIG. 5 shows the structural arrangement in which the shutter portions 7*a* and 7*a* extend from one end of the magnetic flux generation area halfway to the other.

As the magnetic flux adjusting member 7 is rotationally moved into the second position, the portions of the fixation roller 1 corresponding to the out-of-path areas C gradually reduce in temperature. As the temperature level of these portions inputted into the control circuit portion 50 by the peripheral thermistor TH2 falls below the predetermined permissible level, the control circuit portion 50 rotationally moves the magnetic flux adjusting member 7 into the first position to prevent these portions of the fixation roller 1 from becoming too low in temperature.

Further, if an image forming operation which uses recording mediums of a small size is switched to an image forming operation which uses recording mediums of a large size after the magnetic flux adjusting member 7 is moved into the second position during the image forming operation using the recording mediums of the small size, the control circuit portion 50 rotates the magnetic flux adjusting member 7 back into the first position.

As one of the methods for securing a proper amount of gap between the fixation roller 1 and magnetic flux adjusting member 7, there is the method which widens the distance between the magnetic flux adjusting member 7 and fixation roller 1. However, this method suffers from the following problem. That is, as the distance between the magnetic flux adjusting member 7 and fixation roller 1 is increased, the distance between the core 5 and fixation roller 1 increases, and if the distance between the core 5 and fixation roller 1 is increased beyond a certain value, heat exchange efficiency drastically drops. Therefore, currently, this method is seldom used. The holder 6 is extended, in terms of the circumferential direction of the fixation roller 1, to the opposite side of the fixation roller 1 from where the coil 4 is disposed, making the holder 6 roughly circular in cross section, from one lengthwise end to the other. Shaping the holder 6 as described above makes it possible to make the rotational axes of the holder 6, fixation roller 1, and magnetic flux adjusting member 7 coincide, making it therefore possible to improve the fixing apparatus 100 in terms of the accuracy with which these components are positioned relative to each other.

As for the means for transmitting the force for driving the magnetic flux adjusting member 7, the front and rear lengthwise end portions of the holder 6 are fitted with the first and second shutter gears G2 and G3, which are rotatable around the holder 6, as described above. Further, the magnetic flux adjusting member 7 is provided with the aforementioned protrusions 7*c*, which protrude outward from the outward edges of the magnetic flux adjusting member 7. These protrusions 7*c* are engaged with the first and second shutter gears G2 and G3 so that the magnetic flux adjusting member 7 is supported at both of its lengthwise ends, between the gears G2 and G3, by the gears G2 and G3. The shutter gears G2 and G3 are engaged with (fitted around) the holder 6 by the portions which are not engaged with the protrusions 7*c* and 7*c* of the magnetic flux adjusting member 7. Therefore, the magnetic flux adjusting member 7 can be rotated by the gears G2 and G3, following the peripheral surface of the holder 6. The portion of the holder 6, around which the gear G2 is fitted, and the portion of the holder 6, around which the gear G3 is fitted, are rendered uniform in external diameter across the portions largest in external diameter. Here, the expression that the portions of the holder 6, around which the gears G2 and G3 are fitted, one for one, are the largest in external diameter, means that these portions may be provided with ribs so that these portions are rendered uniform in the external diameter inclusive of the ribs. With the use of this structural arrangement, as the holder 6 and magnetic flux adjusting member 7 are engaged with the gears G2 and G3, they are coaxially disposed, making it possible to improve the image heating apparatus in terms of the level of accuracy at which these components are positioned relative to each other.

Basically, the magnetic flux adjusting member 7 is arcuate in cross section from one lengthwise end to the other in terms of the lengthwise direction of the fixation roller 1. The lengthwise end portions of the magnetic flux adjusting member 7 are different in dimension (in terms of circumferential direction of fixation roller 1: arc length in cross-sectional view) from the center portion of the magnetic flux adjusting member 7. When a recording medium of a small size is conveyed through the fixing apparatus, the magnetic flux adjusting member 7 is rotated so that the shutter portions 7*a* and 7*a*, that is, the lengthwise portions, of the magnetic flux adjusting member 7 are moved into the areas where the magnetic flux is generated, in order to prevent the fixation roller 1 from increasing in temperature across the lengthwise end portions. In this embodiment, the magnetic flux is adjusted by moving the shutter portions 7*a* and 7*a*, that is, the magnetic flux blocking portions of the magnetic flux adjusting member 7, into the out-of-path areas of the magnetic flux generation area. However, this is not the only method to adjust a magnetic flux. For example, the following method is possible. That is, the magnetic flux adjusting member 7 is shaped so that the center portion of the magnetic flux adjusting member 7 constitutes the magnetic flux blocking portion (shutter portion) which corresponds in position to the recording medium passage in terms of the lengthwise direction of the fixing apparatus, and this shutter portion is moved into the magnetic flux generation area to change the magnetic flux in the distribution across the area which corresponds to the recording medium passage. In other words, the temperature of the fixation roller 1 may be adjusted by changing the area corresponding to the recording medium path, and the areas corresponding to the areas outside the recording medium path, in the distribution of the amount by which heat is generated, in terms of the lengthwise direction of the fixation roller 1.

Next, referring to FIGS. 11-13, the front and rear supporting members 26 and 27 for supporting the fixation roller 1 and holder 6 by their front and rear end portions, respectively, will be described in somewhat more detail.

The front and rear supporting members 26 and 27 are attached to the front and rear plates 21 and 22 of the fixing apparatus 100, with the use of small screws which are put through the roughly round hole 26*d* and elongated hole 26*e* of the front supporting member 26, and the corresponding holes of the front plate 21 of the fixation apparatus, and through the roughly round hole 27*d* and elongated hole 27*e* of the rear supporting member 27, and the corresponding holes of the rear plate 22 of the fixing apparatus. Therefore, the fixation roller 1 and holder 6 can be easily replaced by removing the small screws.

Figure 11:
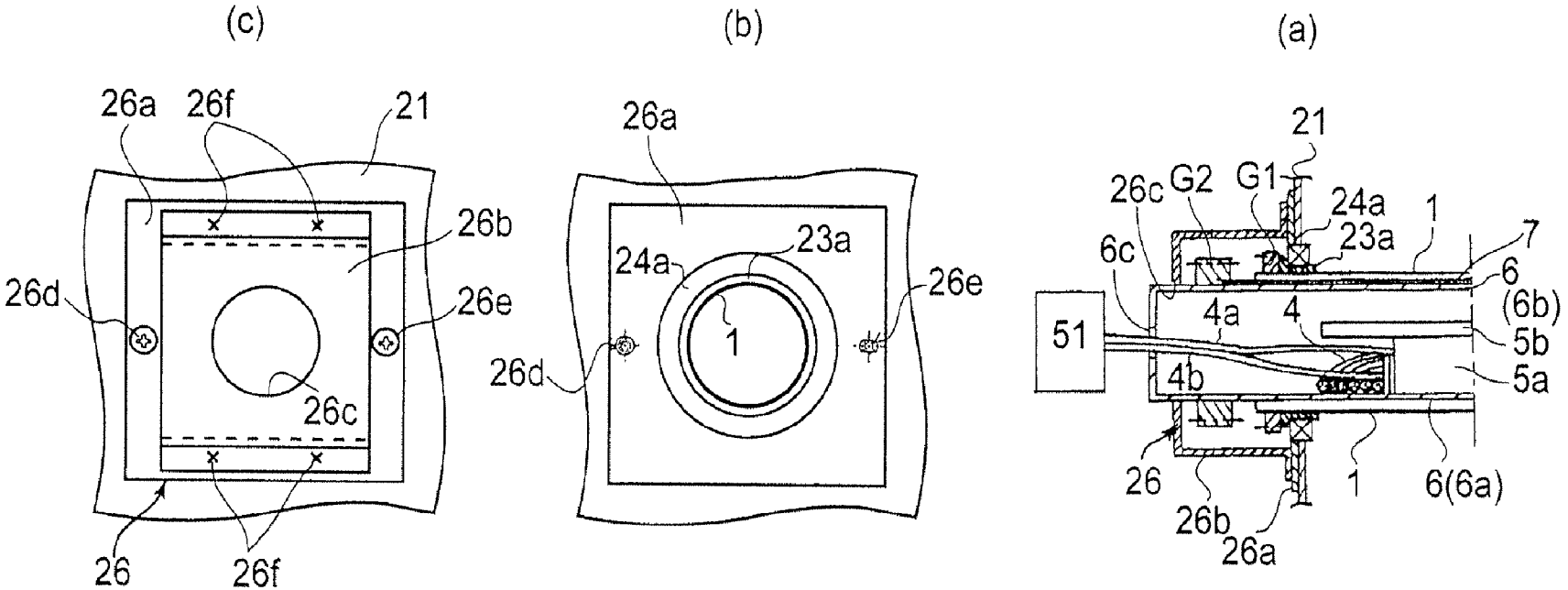
FIG. 11 is a drawing for describing the front supporting member for supporting the fixation roller and holder, by their front end portions.

Referring to FIG. 11, the front supporting member 26 is made up of two portions: first and second portions 26*a* and 26*b*. The first portion 26*a* is provided with a round hole for supporting the bearing 24*a* by the front supporting member 26; the front end portion of the fixation roller 1 is fitted in this hole, with the heat insulating bushing 23*a* placed between the fixation roller 1 and the bearing 24*a*. The second portion 26*b* of the front supporting member 26 is provided with a round hole 26*c* for supporting the cylindrical front end portion of the holder 6.

Further, the first and second portions 26*a* and 26*b* of the front supporting member 26 are spot welded to each other at points 26*f*. As for the method for welding the two portions 26*a* and 26*b* to each other, the portions 26*a* and 26*b* are kept accurately positioned relative to each other with the use of a jig 61 as a means for facilitating the positioning of the portions 26*a* and 26*b* relative to each other, as shown in FIG. 13(*a*), and then, the two portions 26*a* and 26*b* are spot welded to each other. Therefore, it is possible to manufacture the front supporting member 26 capable of coaxially holding the fixation roller 1 and holder 6 at a high level of accuracy.

Figure 12:
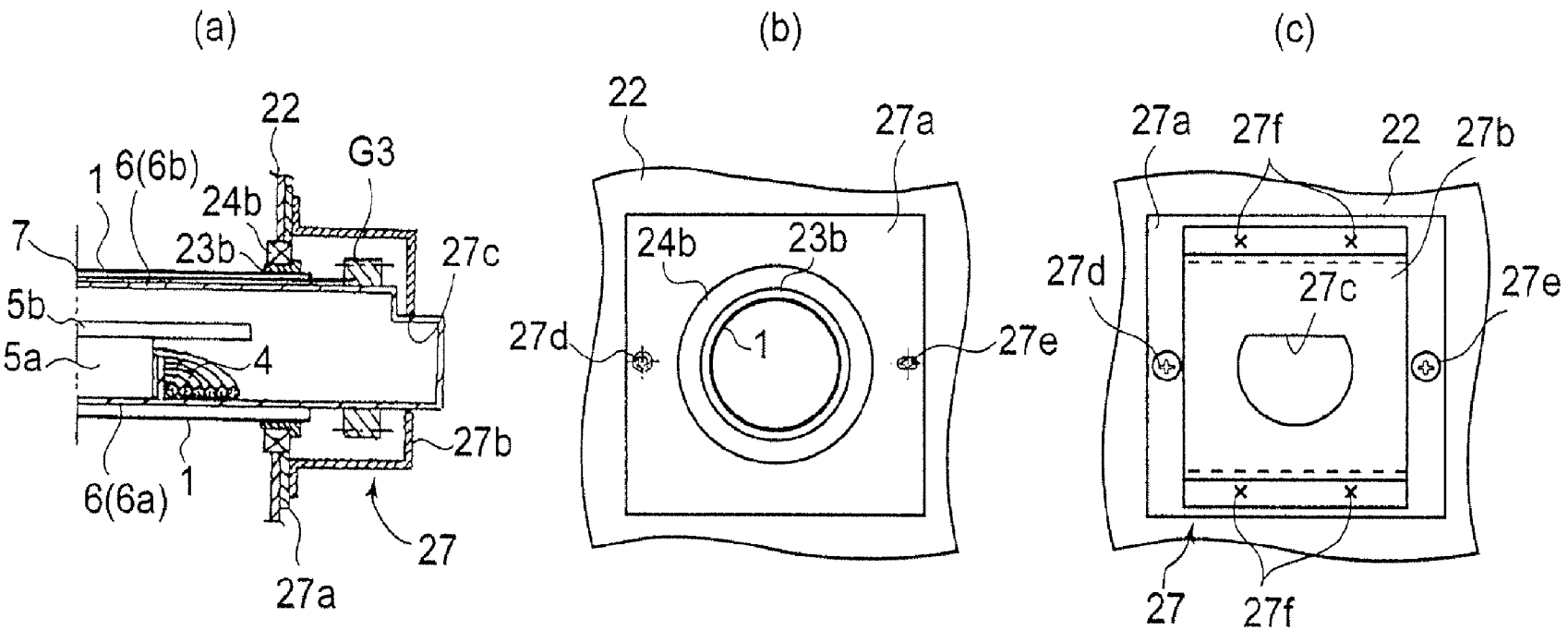
FIG. 12 is a drawing for describing the rear supporting member for supporting the fixation roller and holder, by their rear end portions.
Figure 13:
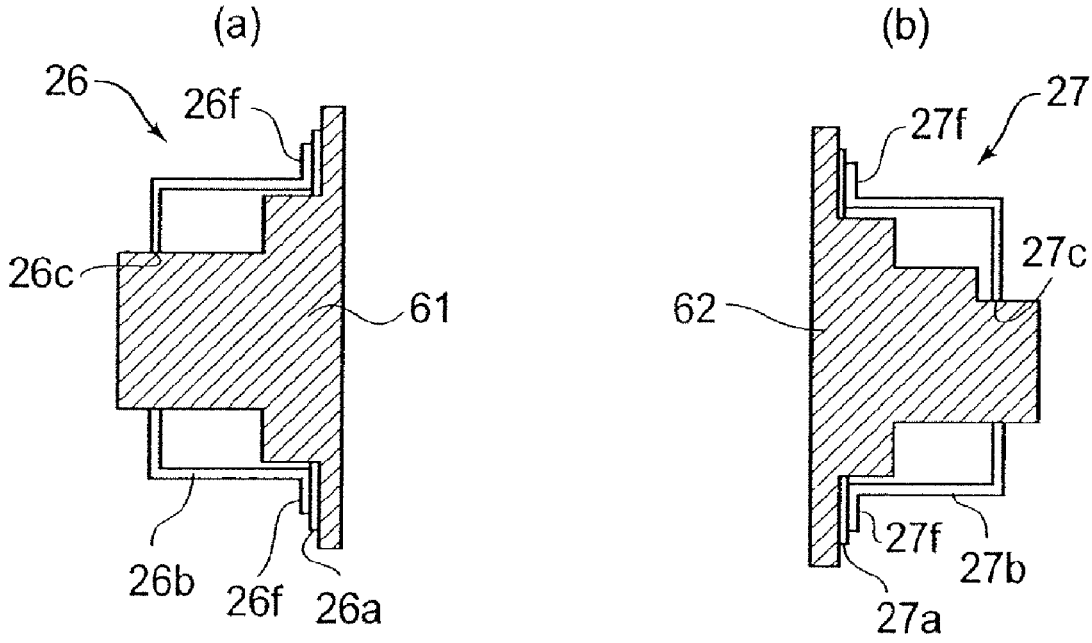
FIG. 13 is a drawing for describing the positioning means for precisely positioning the two portions of front supporting member relative to each other, and the positioning means for precisely positioning the two portions of the rear supporting member relative to each other.
Figure 14:
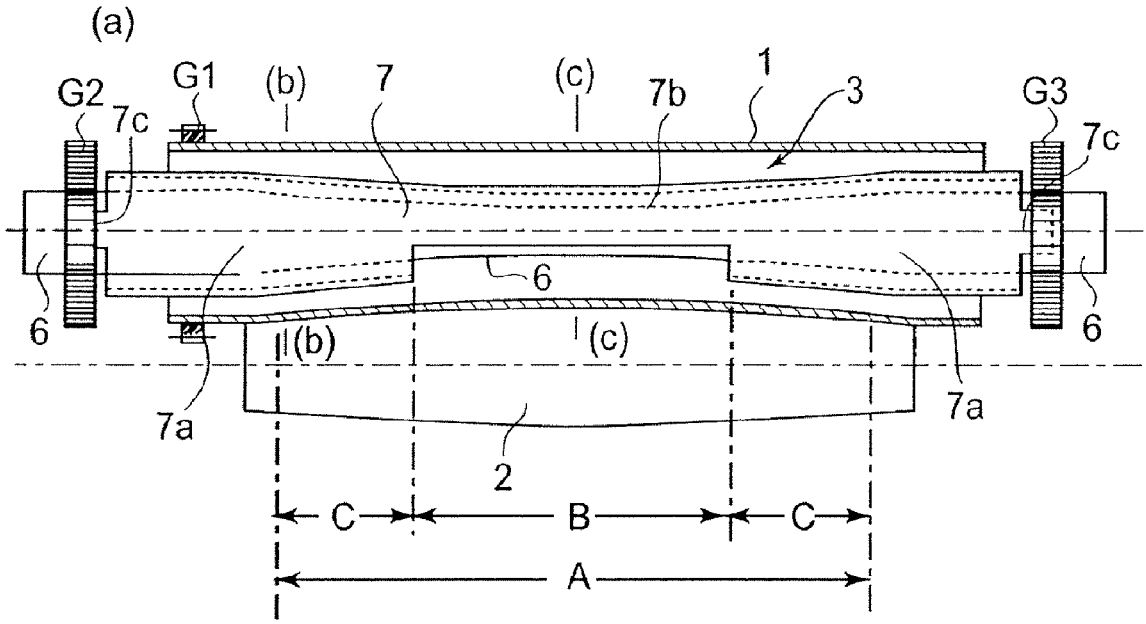
FIG. 14 is a schematic drawing showing exaggeratedly the shape of the magnetic flux adjusting member, which resembles the shape of an inverted crown, and the deformations of the components adjacent to the magnetic flux adjusting member.
Figure 14:
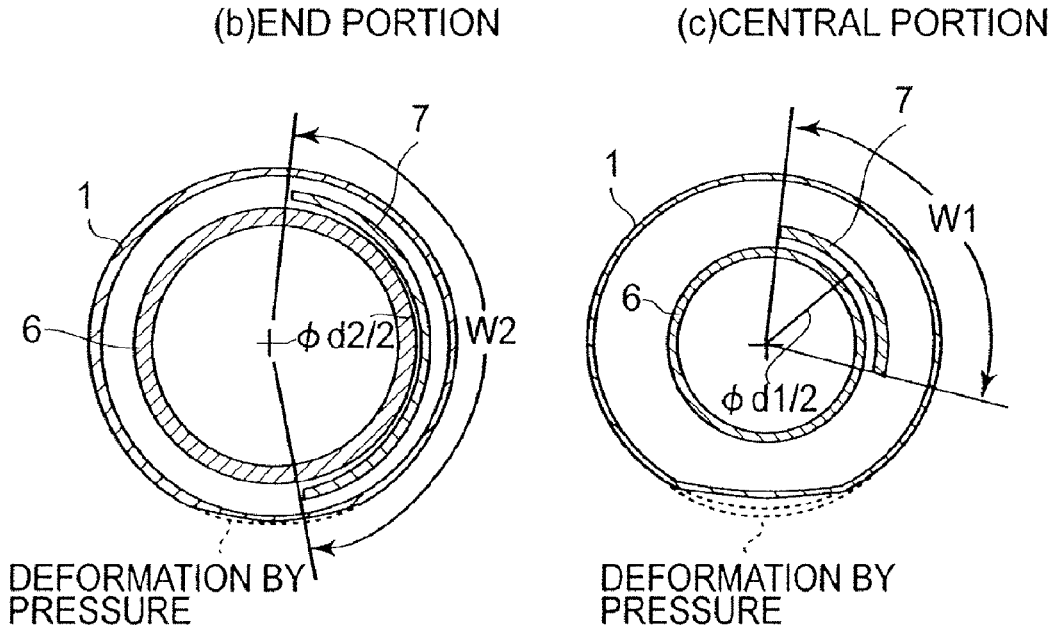

Next, referring to FIG. 12, the rear supporting member 27 is also made up of two portions: first and second portions 27*a* and 27*b*. The first portion 27*a* is provided with a round hole for supporting the bearing 24*b* by the rear supporting member 27; the rear end portion of the fixation roller 1 is fitted in this hole, with the heat insulating bushing 23*b* placed between the fixation roller 1 and the bearing 24*b*. The second portion 27*b* of the rear supporting member 27 is provided with a D-shaped hole 27*c*, in which the rear end portion 6*d* of the holder 6, which is D-shaped in cross section, is fitted to prevent the holder 6 from rotating.

Further, the first and second portions 27*a* and 27*b* of the rear supporting member 27 are spot welded to each other at points 27*f*. As for the method for welding the two portions 27*a* and 27*b* to each other, the portions 27*a* and 27*b* are kept accurately positioned relative to each other with the use of a jig 62 as a means for facilitating the positioning of the portions 27*a* and 27*b* relative to each other, as shown in FIG. 13(*b*), and then, the two portions 27*a* and 27*b* are spot welded to each other. Therefore, it is possible to manufacture the rear supporting member 27 capable of coaxially holding the fixation roller 1 and holder 6 at a high level of accuracy, and also, holding the holder 6 at a predetermined angle, in terms of its circumferential direction, also at a high level of accuracy.

The rear supporting member 27 is attached to the rear plate 22 of the fixing apparatus with the use of small screws put through the roughly round hole and elongated hole located at positions 27*d* and 27*e*, respectively, and the corresponding holes of the rear plate 22, making it thereby possible to prevent the holder 6 from rotating relative to the rear plate 22 of the fixing apparatus.

The fixation roller 1 as a member in which heat is generated, and the holder 6 for supporting the exciting coil assembly 3 as a magnetic flux generating means, are supported by the front and rear supporting members 26 and 27, respectively. The fixation roller 1 is rotatably supported, whereas the holder 6 is nonrotationally supported. Since the fixing apparatus is structured so that the fixation roller 1 and holder 6 are coaxially supported, the fixation roller 1 and holder 6 are improved in the level of accuracy at which they are positioned relative to each other. Therefore, the fixation roller 1 and holder 6 can be more closely positioned relative to each other than was possible in the past, improving therefore the efficiency with which the fixation roller 1 is heated by electromagnetic induction. Therefore, it is possible to reduce the length of time necessary for getting the fixing apparatus 100 up to a predetermined temperature level, thereby substantially improving the fixing apparatus in terms of energy consumption efficiency.

Further, the supporting member 26 for supporting the holder 6 (which is for holding the fixation roller 1 as a member in which heat is generated, and the exciting coil assembly 3 as a magnetic flux generating member) at one of the lengthwise ends of the holder 6 is rendered independent from the supporting member 27 for supporting the holder 6 at the other lengthwise end. Therefore, not only is it possible to maintain the positional relationship between the fixation roller 1 and holder 6 at a higher level of accuracy, but also, to improve the fixing apparatus in terms of the level of ease at which the fixation roller 1, and exciting coil assembly 3 as a magnetic flux generating means 3, can be replaced.

Further, the supporting member 26 is made up of two portions: first portion 26*a* provided with a portion for supporting the fixation roller 1, and second portion 26*b* separate from the first portion 26*a* and provided with a portion for supporting the holder 6 for supporting the exciting coil assembly 3. The supporting portion 27 is also made up of two portions: first portion 27*a* provided with a portion for supporting the fixation roller 1, and second portion 27*b* separate from the first portion 27*a* and provided with a portion for supporting the holder 6 for supporting the exciting coil assembly 3. Moreover, the first and second portions 26*a* and 26*b* of the first supporting members 26 are spot welded to each other while being kept precisely positioned relative to each other with the use of the jig 61 for precisely positioning the two portions 26*a* and 26*b*, and the portions 27*a* and 27*b* of the second supporting member 27 are spot welded to each other, with the use of the jig 62 for precisely positioning the two portions 27*a* and 27*b*. Therefore, not only can the fixation roller 1 be more precisely positioned relative to the holder 6, but also, the supporting members 26 and 27 are easier to manufacture.

Because of these effects of this embodiment described above, it is possible to position the fixation roller 1 substantially closer to the holder 6 for holding the exciting coil assembly 3 as a magnetic flux generating means than in the past, making it possible to improve the fixing apparatus in terms of the level of efficiency at which heat is generated in the fixation roller 1 by electromagnetic induction. Further, it is possible to reduce the length of time (startup time) necessary to increase the temperature of the fixation roller 1 to a predetermined level suitable for image fixation, drastically improving the fixing apparatus in terms of energy consumption efficiency.

Further, the magnetic flux adjusting member 7 of a heating apparatus (fixing apparatus) can be precisely rotated into one of the predetermined magnetic flux adjusting positions according to the recording medium size, with no chance of malfunctioning. Moreover, this embodiment was effective to improve a fixing apparatus in the length of service life, in addition to the above described improvements related to performance. Thus, this embodiment made it possible to eliminate the problem that the magnetic flux adjusting member 7 sometimes fails to be properly rotated into one of the predetermined positions. Therefore, it has become possible to prevent the temperature of the fixation roller 1 from unwantedly increasing across the portions corresponding to the areas outside the path of the recording medium being conveyed through the fixing apparatus.

In the case of the fixing apparatus in this embodiment, the internal diameter of the fixation roller 1 as a member in which heat is generated, is roughly 46 mm, and the exciting coil assembly 3 as a magnetic flux generating means is disposed within the hollow of the fixation roller 1. The external diameter of the holder 6 for holding the exciting coil assembly 3 is roughly 40 mm. The magnetic flux adjusting member 7 is roughly 40 mm in external diameter at both of its lengthwise ends, and roughly 400 mm in length. Thus, as the magnetic flux adjusting member 7 is exposed to a temperature level of roughly 200° C. for an extended length of time, it sags across the center portion due to its own weight, coming into contact with the internal surface of the fixation roller 1. Should the control circuit portion 50 rotationally drive the magnetic flux adjusting member 7 while the magnetic flux adjusting member 7 is in this state, the frictional resistance between the most sagging portion of the magnetic flux adjusting member 7 and the internal surface of the fixation roller 1 drastically reduces the magnetic flux adjusting member 7 in terms of the level of reliability at which it can be rotated to one of the aforementioned predetermined positions.

In this embodiment, therefore, the external diameter of the lengthwise center portion of the magnetic flux adjusting member 7 is made to be roughly 38 mm even though it is roughly 40 mm at both of its lengthwise ends. In other words, the magnetic flux adjusting member 7 is given a shape similar to the shape of an inverted crown.

The material for the magnetic flux adjusting member 7 is a piece of roughly 0.5 mm thick copper plate. The copper plate is pressed with the use of a cylindrical die, the lengthwise center portion of which is arcuately bulging by 0.3 mm, to transfer the shape of the die (shape of which resembles the shape of an inverted crown) onto the copper plate, forming thereby the magnetic flux adjusting member 7. With the magnetic flux adjusting member 7 shaped like an inverted crown, the sagging of the lengthwise center portion of the magnetic flux adjusting member 7 attributable to the heat from the fixation roller 1 and its own weight is compensated for by the shape of the magnetic flux adjusting member 7. Therefore, the effect of the sagging of the lengthwise center portion of the magnetic flux adjusting member 7 is minimized. Therefore, it is possible to reduce the extent of the problem that as the gap between the holder 6 for holding the exciting coil assembly 3 as a magnetic flux generating means, and the fixation roller 1 as a member in which heat is generated, is reduced, the above described deformation of the magnetic flux adjusting member 7 causes the magnetic flux adjusting member 7 to come into contact with the fixation roller 1.

Incidentally, the extent to which the magnetic flux adjusting member 7 is to be shaped like an inverted crown is to be determined according to the extent of the deformation of the magnetic flux adjusting member 7 attributable to its own weight, and the extent of the deformation of the fixation roller 1 attributable to the pressure applied thereto. Thus, there is no universal answer to this question. As the material for the magnetic flux adjusting member 7, such a nonferrous metal as aluminum or copper, in particular, a nonferrous metal which is low in electrical resistance is preferable. However, it does not need to be limited to copper, which is used in this embodiment.

As for the method for ensuring that a certain amount of gap is maintained between the fixation roller 1 and magnetic flux adjusting member 7, it is possible to widen the distance between the fixation roller 1 and magnetic flux adjusting member 7. However, this method is problematic in that as the distance between the fixation roller 1 and magnetic flux adjusting member 7 is increased beyond a certain value, heat exchange efficiency drastically decreases. Therefore, currently, this method is seldom used.

The holder 6 for holding the exciting coil assembly 3 as a magnetic flux generating means is rendered roughly circular in cross section, from one lengthwise end to the other. Giving this shape to the holder 6 makes it possible to coaxially dispose the holder 6, fixation roller 1, and magnetic flux adjusting member 7, improving thereby the fixing apparatus in terms of the level of accuracy at which the holder 6, fixation roller 1, and magnetic flux adjusting member 7 are positioned relative to each other, and also, the level of accuracy at which their positional relationship can be maintained.

Basically, the magnetic flux adjusting member 7 is rendered roughly arcuate in cross section from one lengthwise end to the other, and the lengthwise end portions of the magnetic flux adjusting member 7 are rendered different from the center portion of the magnetic flux adjusting member 7, in the length of the arced portion, in terms of the circumferential direction of the fixation roller 1. That is, in terms of the circumferential direction of the fixation roller 1, the length w1 of the arced portion of the lengthwise center portion of the magnetic flux adjusting member 7 is rendered shorter than the length w2 of each of the lengthwise end portions of the magnetic flux adjusting member 7. As described above, the shutter gears G2 and G3 for driving the magnetic flux adjusting member 7 are fitted around the holder 6, and the magnetic flux adjusting member 7 is provided with the pair of protrusions 7*c* and 7*c*, which protrude from the lengthwise ends of the magnetic flux adjusting member 7. The pair of protrusions 7*c* and 7*c* are engaged with the shutter gears G2 and G3, one for one. Further, the shutter gears G2 and G3 are engaged with (fitted around) the holder 6 by the portions which are not engaged with the magnetic flux adjusting member 7. Therefore, the magnetic flux adjusting member 7 can be rotated by the gears G2 and G3, following the peripheral surface of the holder 6.

The portions of the holder 6, around which the shutter gears G2 and G3 are fitted one for one, are rendered uniform in external diameter across the portions largest in external diameter; they are not shaped like an inverted crown. Here, the expression that the portions of the holder 6, around which the gears G2 and G3 are fitted, one for one, are the largest in external diameter, means that these portions may be provided with ribs so that these portions are rendered uniform in the external diameter inclusive of the ribs. With the use of this structural arrangement, as the holder 6 and magnetic flux adjusting member 7 are engaged with the gears G2 and G3, they are coaxially disposed, making it possible to improve the image heating apparatus in terms of the level of accuracy at which these components are positioned relative to each other.

As described above, the magnetic flux adjusting member 7 is shaped so that the relationship between the external diameter d1 of the center portion of the magnetic flux adjusting member 7 and the external diameter d2 of each of the virtual end portions of the magnetic flux adjusting member 7, in terms of the lengthwise direction of the magnetic flux adjusting member 7, that is, the direction perpendicular to the direction in which an object to be heated is conveyed, satisfies the following inequality: d1 <d2. Therefore, the distance between the magnetic flux adjusting member 7, and the fixation roller 1 as a member in which heat is generated, which is changed by the weight of the magnetic flux adjusting member 7 itself, and the deformation of the fixation roller 1 attributable to the pressure applied thereto, can be set to an optimal value.

Further, the magnetic flux adjusting member 7 is shaped so that at least one of the lengthwise portions of the magnetic flux adjusting member 7, having the external diameter of d2, are rendered uniform in external diameter across the portion largest in external diameter. This structural arrangement makes it easier to engage the lengthwise end portions of the magnetic flux adjusting member 7 with the corresponding magnetic flux adjusting member holding members, making it thereby possible to position the holder 6 and fixation roller 1 relative to each other at a higher level of accuracy.

Further, the magnetic flux adjusting member 7 is rendered roughly circular (roughly arcuate) in cross section, from one lengthwise end to the other. Therefore, the cylindrical fixation roller 1, and the holder 6, can be held at a high level of accuracy, relative to each other, simply by engaging the lengthwise ends of the fixation roller 1, and the lengthwise ends of the holder 6, with the corresponding supporting members having the hole for supporting them.

Because of these effects of this embodiment described above, the magnetic flux adjusting member 7 can be precisely rotated into one of the predetermined magnetic flux adjusting positions according to recording medium size, with no chance of malfunctioning. Moreover, this embodiment was effective to improve a fixing apparatus in the length of service life, in addition to the above described improvements related to performance. Thus, this embodiment made it possible to eliminate the problem that the magnetic flux adjusting member 7 sometimes fails to be properly rotated into one of the predetermined positions. Therefore, it became possible to properly control the increase in the temperature of the fixation roller 1 across the portions corresponding to the areas outside the path of the recording medium being conveyed through the fixing apparatus.

Next, the manufacturing sequences and procedures, which are to be followed when attaching the above described various components of the fixing apparatus 100 to the front and rear plates 21 and 22 of the fixing apparatus 100, will be described.

Objective: to replace the fixation roller 1, which is a component to be replaced at predetermined intervals, and the holder 6, bearings 24*a* and 24*b*, heat insulating bushings 23*a* and 23*b*, magnetic flux adjusting member 7 (shutter), gears G2 and G3, etc., which are to be replaced as they break down.

Procedure 1: remove the top unit of the fixing apparatus—remove the bottom unit inclusive of the pressure roller, and the fixation roller driving unit.

Procedure 2: remove the front and rear supporting members 26 and 27—remove the fixation roller 1 (inclusive of gears G1, heat insulating bushings 23*a* and 23*b*, and bearings 24*a* and 24*b*), holder 6, shutter 7, and shutter gears G2 and G3.

Procedure 3: remove unshown grip ring (thrust damper), and remove the gear G1, heat insulating bushings 23*a* and 23*b*, and bearings 24*a* and 24*b*, from the fixation roller 1, and replace them with new ones.

(3) Miscellaneous

Figure 15:
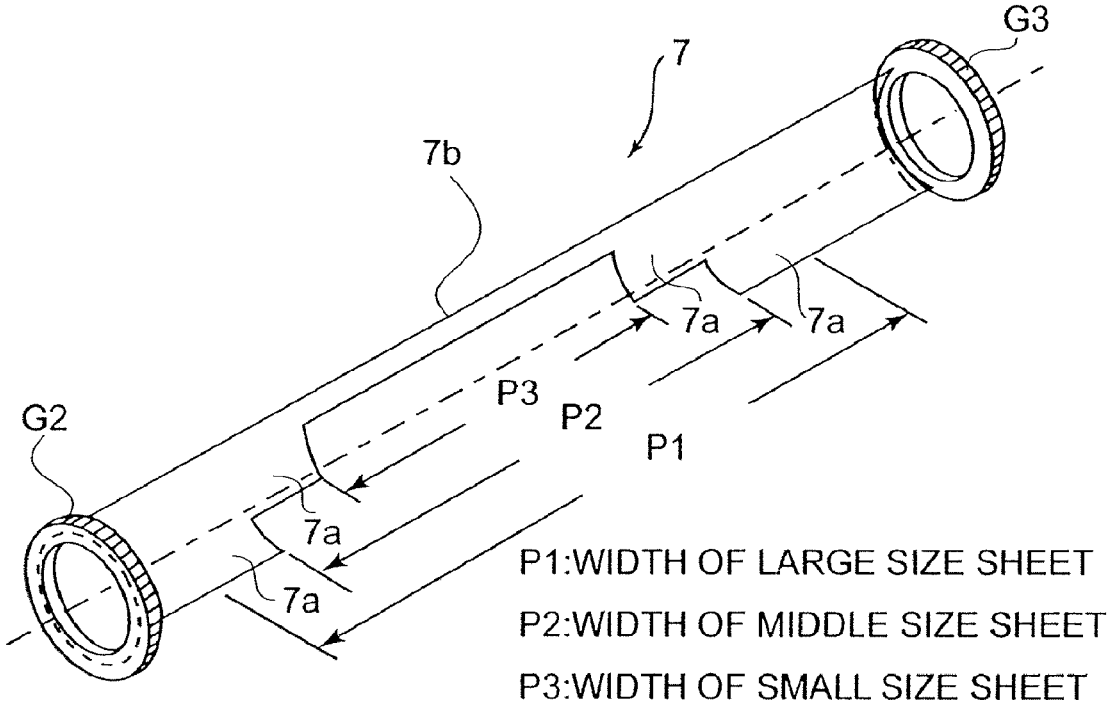
FIG. 15 is a schematic perspective view of the magnetic flux adjusting member given such a shape that enables it to accommodate three kinds of recording mediums different in width (large, medium, and small sizes).

1) The fixing apparatus in this embodiment is structured to accommodate two kinds of recording mediums different in size: a recording medium of a large size and a recording medium of a small size. Thus, its magnetic flux adjusting member 7 is moved into the first position or second position according to the size of the recording medium. However, this embodiment is not intended to limit the scope of the present invention. Obviously, a fixing apparatus may be structured so that its magnetic flux adjusting member is moved to one of three or more positions according to three or more recording medium sizes (widths). FIG. 15 is a schematic perspective view of a magnetic flux adjusting member 7 structured to accommodate three kinds of recording mediums different in width.

Figure 16:
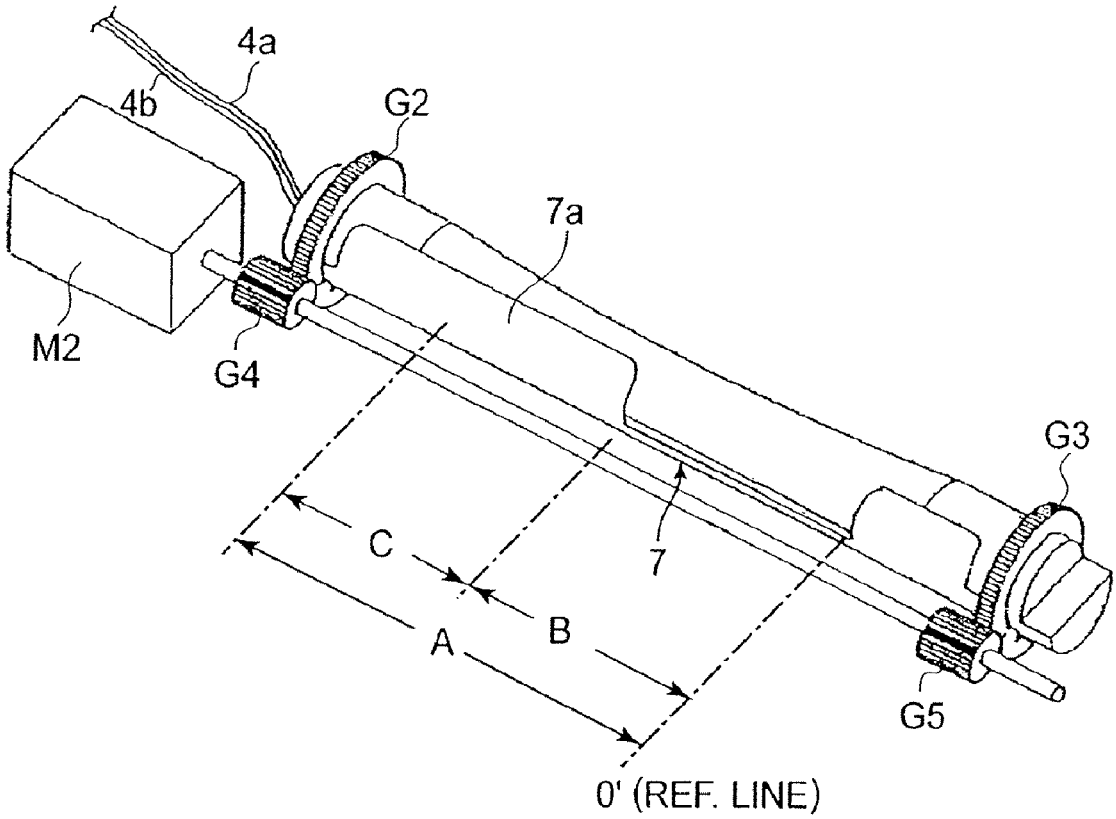
FIG. 16 is a schematic perspective view of an example of a magnetic flux adjusting member for a fixing apparatus (image forming apparatus) in which a recording medium is conveyed while one of its lateral edges is kept aligned with the positional reference with which the apparatus is provided.
Figure 17:
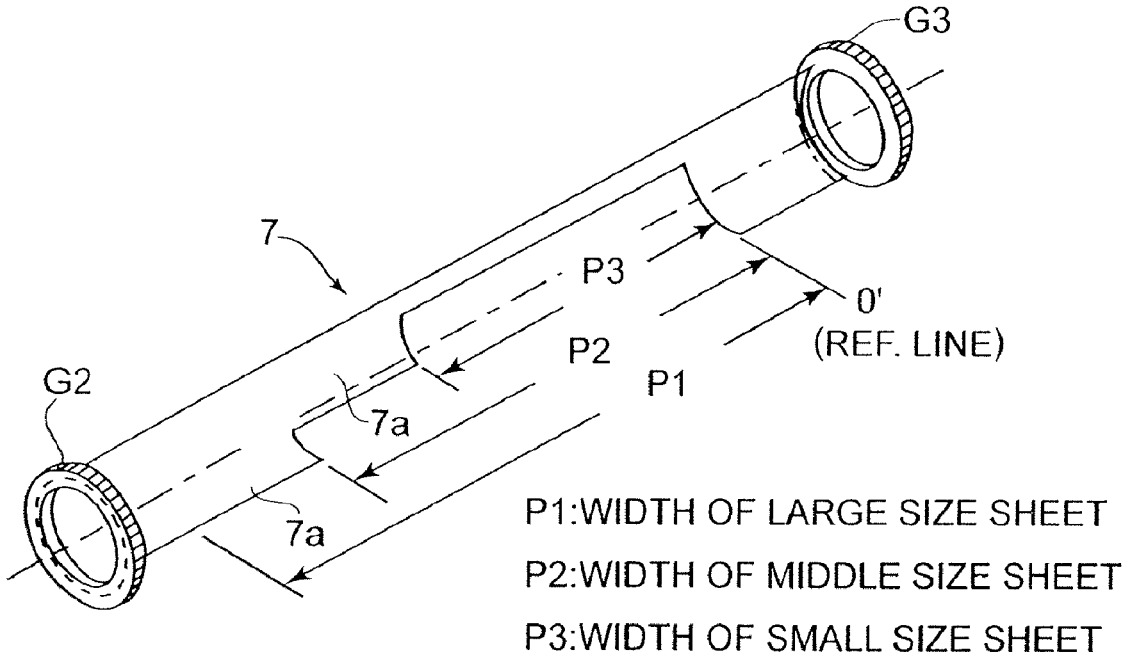
FIG. 17 is another example of a magnetic flux adjusting member for a fixing apparatus (image forming apparatus) in which a recording medium is conveyed while one of its lateral edges is kept aligned with the positional reference with which the apparatus is provided.

2) The fixing apparatus (image forming apparatus) is structured to convey a recording medium in such a manner that the centerline of the recording medium, in terms of the direction perpendicular to the recording medium conveyance direction, coincides with the lengthwise center of the fixation roller. However, the present invention is effectively applicable also to a fixing apparatus (image forming apparatus) structured to convey a recording medium in such a manner that one of the lateral edges of a recording medium is kept aligned with a referential line (member) with which the apparatus is provided. FIGS. 16 and 17 show the examples of the shape of the magnetic flux adjusting member for such an apparatus, that is, an apparatus in which the position of a recording medium relative to the apparatus, in terms of its width direction, is controlled with reference to only one of its lateral edges. The lines, in the two drawings, designated by a referential symbol O' are the referential lines for positioning a recording medium.

3) An image heating apparatus employing a heating method based on electromagnetic induction, to which the present invention is applicable, is not limited to the image heating apparatus in this embodiment. That is, the present invention is also applicable to an image heating apparatus such as an image heating apparatus for temporarily fixing an unfixed image to a recording medium, and an image heating apparatus for reheating a recording medium bearing a fixed image to change the fixed image in surface properties such as glossiness. Moreover, the present invention is effectively applicable to a heating apparatus for heating an object in the form of a sheet, for example, a thermal pressing apparatus for removing wrinkles from an object in the form of a sheet, a thermal laminating apparatus, or a thermal drying apparatus for evaporating water content from such an object as a sheet of paper, etc., which variable applications are obvious.

While the invention has been described with reference to the structures disclosed herein, it is not confined to the details set forth, and this application is intended to cover such modifications or changes as may come within the purposes of the improvements or the scope of the following claims.

This application claims Priority from Japanese Patent Application No. 308506/2004 filed Oct. 22, 2004, which is hereby incorporated by reference.

What is claimed is:

1. An image heating apparatus, comprising:

a coil for generating magnetic flux;

a rotatable heat generating member for generating heat by a magnetic flux generated by the coil to heat an image on a recording material;

a magnetic flux adjusting member for adjusting a distribution, with respect to a rotational axis direction of said heat generating member, of the magnetic flux directing from said coil toward said heat generating member;

a motor;

a first gear, mounted to one end portion of said magnetic flux adjusting member, for transmitting a driving force from said motor to said magnetic flux adjusting member;

a second gear, mounted to the other end portion of said magnetic flux adjusting member, for transmitting a driving force from said motor to said magnetic flux adjusting member; and moving means for moving said magnetic flux adjusting member by transmitting the driving force from said motor to both of said first gear and said second gear.

2. An apparatus according to claim 1, wherein said magnetic flux adjusting member is disposed between said coil and said heat generating member.

3. An apparatus according to claim 1, wherein said moving means includes a third gear for transmitting a driving force from said motor to said first gear, a fourth gear for transmitting the driving force from said motor to said second gear, and a shaft member supporting said third gear and said fourth gear.

4. An apparatus according to claim 3, wherein said first gear and said second gear are disposed outside an end of said heat generating member with respect to the rotation axial direction.

5. An apparatus according to claim 3, wherein said shaft member is drived by said motor.

6. An apparatus according to claim 1, further comprising a drive transmission member, mounted to said heat generating member, for transmitting a driving force to said heat generating member, said drive transmission member being disposed inside said first gear with respect to the rotation axial direction.

7. An apparatus according to claim 6, further comprising a second motor for supplying a drive force to said drive transmission member.

8. An apparatus according to claim 1, wherein said magnetic flux adjusting member includes a metal plate.

9. An image heating apparatus, comprising:

a coil for generating magnetic flux;

a rotatable heat generating member for generating heat by a magnetic flux generated by the coil to heat an image on a recording material;

a magnetic flux adjusting means, having a movable member, for adjusting a distribution, with respect to a rotational axis direction of said heat generating member, of the magnetic flux directing from said coil toward said heat generating member;

a motor;

a first drive transmission member, mounted to one end portion of said magnetic flux adjusting means, for transmitting a driving force from said motor to said magnetic flux adjusting means;

a second drive transmission member, mounted to the other end portion of said magnetic flux adjusting means, for transmitting a driving force from said motor to said magnetic flux adjusting means;

a third drive transmission member for transmitting a driving force from said motor to said first drive transmission member;

a fourth drive transmission member for transmitting the driving force from said motor to said second drive transmission member; and a shaft member supporting said third drive transmission member and said fourth drive transmission member.

10. An apparatus according to claim 9, wherein said movable member is disposed between said coil and said heat generating member.

11. An apparatus according to claim 9, wherein said first drive transmission member and said second drive transmission member are disposed outside an end of said heat generating member with respect to the rotation axial direction.

12. An apparatus according to claim 9, further comprising a fifth drive transmission member, mounted to said heat generating member, for transmitting a driving force to said heat generating member, said fifth drive transmission member being disposed inside said first drive transmission member with respect to the rotation axial direction.

13. An apparatus according to claim 12, further comprising a second motor for supplying a driving force to said fifth drive transmission member.

14. An apparatus according to claim 9, wherein said movable member includes a metal plate.

15. An apparatus according to claim 9, wherein shaft member is drived by said motor.

16. An apparatus according to claim 9, wherein said first drive transmission member, said second drive transmission member, said third drive transmission member, and said fourth drive transmission member are in the form of gears.

* * * * *